US008965226B2

(12) United States Patent
Kunimatsu et al.

(10) Patent No.: US 8,965,226 B2
(45) Date of Patent: Feb. 24, 2015

(54) IMAGE FORMING APPARATUS

(75) Inventors: Miho Kunimatsu, Tokyo (JP); Masato Kobayashi, Kashiwa (JP)

(73) Assignee: Canon Finetech Inc., Misato-shi (JP)

( * ) Notice: Subject to any disclaimer, the term of this patent is extended or adjusted under 35 U.S.C. 154(b) by 127 days.

(21) Appl. No.: 13/432,572

(22) Filed: Mar. 28, 2012

(65) Prior Publication Data

US 2012/0189330 A1 Jul. 26, 2012

Related U.S. Application Data

(63) Continuation of application No. PCT/JP2011/006919, filed on Dec. 12, 2011.

(30) Foreign Application Priority Data

Dec. 10, 2010 (JP) ..... 2010-275695
Dec. 9, 2011 (JP) ..... 2011-269859

(51) Int. Cl.
*G03G 15/02* (2006.01)
*G03G 15/00* (2006.01)
*G03G 15/16* (2006.01)

(52) U.S. Cl.
CPC ..... *G03G 15/657* (2013.01); *G03G 15/1665* (2013.01)
USPC ..... 399/50; 399/315

(58) Field of Classification Search
USPC ..... 399/50, 66, 315, 397, 398
See application file for complete search history.

(56) References Cited

U.S. PATENT DOCUMENTS 6,339,691 B1 * 1/2002 Kamei ..... 399/315

FOREIGN PATENT DOCUMENTS

| | | | | |
|---|---|---|---|---|
| JP | 61205962 A | * | 9/1986 | ..... G03G 15/02 |
| JP | 11-84892 A | | 3/1999 | |
| JP | 2000-214690 A | | 8/2000 | |
| JP | 2003-84630 A | | 3/2003 | |
| JP | 2005-241947 A | | 9/2005 | |
| JP | 2009-31785 A | | 2/2009 | |

OTHER PUBLICATIONS

International Search Report dated Jan. 17, 2012, in International Application No. PCT/JP2011/006919.

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes: an image bearing member; a charging device which charges the image bearing member; a developing device which develops an electrostatic image formed on the image bearing member with toner; a transferring device which transfers a toner image formed on the image bearing member by the developing device onto a recording medium; a separation charge-eliminator disposed opposite to the image bearing member, for separating the medium from the image bearing member after transfer; a current detecting device which detects a separation current flowing through the charge-eliminator; and a control device which outputs a control signal regarding the charge-eliminator based on a first current value detected by the current detecting device with a charging voltage being applied to the charging device and a second current value detected by the current detecting device with a transfer voltage being applied to the transferring device.

21 Claims, 16 Drawing Sheets

FIG. 5

| | CURRENT VALUE | | |
|---|---|---|---|
| | H/H | N/N | N/L |
| CURRENT THRESHOLD VALUE BETWEEN PHOTOSENSITIVE DRUM AND SEPARATION CHARGE-ELIMINATOR AT THE TIME OF APPLICATION OF CHARGING BIAS | −4 μA | −3 μA | −1 μA |
| CURRENT THRESHOLD VALUE BETWEEN TRANSFER ROLLER AND SEPARATION CHARGE-ELIMINATOR AT THE TIME OF APPLICATION OF TRANSFER BIAS | +8 μA | +5 μA | +2 μA |

FIG. 14

| | CURRENT VALUE | | |
|---|---|---|---|
| | H/H | N/N | N/L |
| CURRENT THRESHOLD VALUE BETWEEN PHOTOSENSITIVE DRUM AND SEPARATION CHARGE-ELIMINATOR AT THE TIME OF APPLICATION OF CHARGING BIAS | +7 μA | +4 μA | +1 μA |
| CURRENT THRESHOLD VALUE BETWEEN TRANSFER ROLLER AND SEPARATION CHARGE-ELIMINATOR AT THE TIME OF APPLICATION OF TRANSFER BIAS | +15 μA | +10 μA | +5 μA |

IMAGE FORMING APPARATUS

CROSS-REFERENCE TO RELATED APPLICATIONS

This application is a continuation of International Application No. PCT/JP2011/006919, filed Dec. 12, 2011, which claims the benefit of Japanese Patent Application No. 2010-275695, filed Dec. 10, 2010 and Japanese Patent Application No. 2011-269859, filed Dec. 9, 2011.

BACKGROUND OF THE INVENTION

1. Field of the Invention

The present invention relates to an electrophotographic image forming apparatus provided with a separation charge-eliminator which separates a recording medium from an image bearing member after a developer image formed on the image bearing member is transferred onto the recording medium.

2. Description of the Related Art

The electrophotographic image forming apparatus includes an image bearing member, a charging device which charges the image bearing member, an exposure device which forms an electrostatic image on the image bearing member, a developing device which develops the electrostatic image by using a developer (toner), and a transferring device which transfers a toner image formed on the image bearing member by the developing device onto the recording medium.

A transfer roller being the transferring device is disposed in contact with the image bearing member (photosensitive drum) and forms a transferring nip in a contact region. A transfer voltage having a polarity reverse to the toner image is applied to the transfer roller to thereby transfer the toner image on the photosensitive drum onto the recording medium. However, the polarity of the potential of a surface of the photosensitive drum is a polarity reverse to the polarity of the recording medium after the transferring, and hence when the recording medium passes through the transferring nip in which the transfer roller is in contact with the photosensitive drum, the recording medium may be attracted electrostatically to the photosensitive drum. Accordingly, the recording medium is electrostatically attracted to the photosensitive drum, which causes a problem of image quality deterioration on the recording medium or a conveyance failure (jam) of the recording medium.

In order to solve this problem, up to now, it is proposed that a separation charge-eliminator which eliminates charges from the recording medium immediately after the recording medium passes the transferring nip be provided in a position in proximity to the transferring device. A separation voltage having the polarity reverse to the polarity of the recording medium after the transferring is applied to the separation charge-eliminator.

In the image forming apparatus that employs a method of separating the recording medium from the image bearing member as described above, a stain on the separation charge-eliminator is one of failures that arise when an interior of the apparatus is stained with paper dust or flying toner. When the paper dust or the toner adheres to and stains the separation charge-eliminator, the electric resistance thereof increases, and in a case where the separation voltage is a constant voltage, the separation charge-eliminating current decreases. Accordingly, the separation charge-eliminator becomes less effective in charge elimination, and hence the recording medium is kept from being separated from the photosensitive drum, which leads to a fear that a recording medium jam may occur or the image quality may deteriorate.

Therefore, an image forming apparatus described in Japanese Patent Application Laid-Open No. 2005-241947 applies the transfer voltage to the transferring device, and detects the current value of a current flowing from the transferring device into the separation charge-eliminator by discharge. It is proposed therein that the separation voltage to be applied to the separation charge-eliminator be controlled depending on the detected current value to thereby alleviate the image quality deterioration or a jam occurrence.

In recent years, various kinds of recording media used for the image forming apparatus are distributed, and some recording media cause a large amount of paper dust when the recording medium is transported. In the case of using a large number of recording media that cause a large amount of paper dust, the paper dust is piled up in a periphery of the separation charge-eliminator so as to cover the separation charge-eliminator at an early stage after the start of use of the image forming apparatus.

By using the technology described in Japanese Patent Application Laid-Open No. 2005-241947, the stain such as the piled-up paper dust is detected only in a direction in which the current flows into the separation charge-eliminator from the transferring device located on an upstream side of the separation charge-eliminator in a recording-medium conveying direction. This leads to a fear that it may not be possible to detect the paper dust piled up in a periphery of a distal end of the separation charge-eliminator disposed opposite to the image bearing member in a direction from the separation charge-eliminator to the image bearing member.

SUMMARY OF THE INVENTION

The present invention has been made in view of the above-mentioned problem, and an object thereof is to provide an image forming apparatus in which, when use thereof causes a separation charge-eliminator to be stained with paper dust or toner adhering thereto, it is possible to determine its stained condition and perform maintenance with accuracy.

In order to achieve the above-mentioned object, representative structure of an image forming apparatus of the present invention includes: an image bearing member; a charging device to which a charging voltage is applied, for charging the image bearing member; a developing device which develops an electrostatic image formed on the image bearing member by using toner; a transferring device disposed opposite to the image bearing member, a transfer voltage being applied to the transferring device which transfers a toner image formed on the image bearing member by the developing device onto a recording medium; a separation charge-eliminator disposed opposite to the image bearing member, for separating the recording medium from the image bearing member after transfer; a current detecting device which detects a separation current flowing through the separation charge-eliminator; and a control device which informs about the separation charge-eliminator based on a first detected current value of the separation current detected by the current detecting device with the charging voltage being applied to the charging device and a second detected current value of the separation current detected by the current detecting device with the transfer voltage being applied to the transferring device.

Further features of the present invention will become apparent from the following description of exemplary embodiments with reference to the attached drawings.

BRIEF DESCRIPTION OF THE DRAWINGS

FIG. 5 is a table showing an example of a threshold table of a separation current value.

FIG. 14 is a table showing an example of a threshold table of the separation current value according to the third embodiment.

DESCRIPTION OF THE EMBODIMENTS

Next, an image forming apparatus according to one embodiment of the present invention will be described specifically with reference to the accompanying drawings.

First Embodiment

Overall Structure of Image Forming Apparatus

Figure 1:
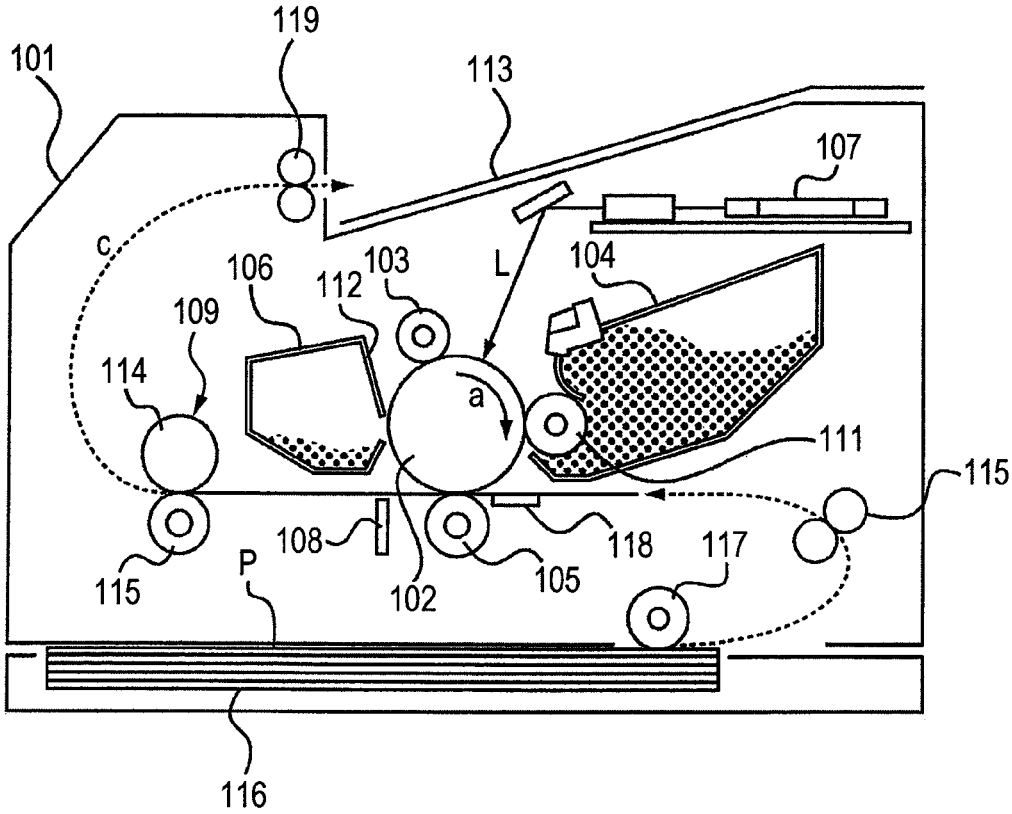
FIG. 1 is an explanatory diagram of a structure of an image forming apparatus.

First, by referring to FIG. 1, an overall structure of the image forming apparatus according to the first embodiment will be described. An image forming apparatus 101 according to this embodiment is a laser printer of an electrophotographic method, and is provided with a photosensitive drum 102 serving as an image bearing member so as to be rotatable. Disposed around the photosensitive drum 102 are a charging roller 103 being a charging device, a developing device 104 including a developing sleeve 111, a transfer roller 105 being a transferring device, and a cleaning device 106 in order of mention in a rotational direction "a" of the photosensitive drum 102. Further, an exposure device 107 is disposed above a position between the charging roller 103 and the developing device 104. In addition, a fixing device 109 is disposed on a downstream side in a recording medium conveying direction of a transferring nip portion formed in an opposed region between the photosensitive drum 102 and the transfer roller 105.

Next, a description will be provided of image formation. The photosensitive drum 102 is rotationally driven in the direction indicated by the arrow "a" at a predetermined peripheral speed, and is uniformly charged to a predetermined potential of a negative polarity by a charging voltage applied to the charging roller 103. Then, the charged photosensitive drum 102 is irradiated with scanning exposure light L according to an image signal by the exposure device 107 so that an electrostatic image is formed on the photosensitive drum 102. Toner being a developer is caused to adhere to the electrostatic image in a developing region by reversal development by the developing sleeve 111 to which a developing voltage having a negative polarity is applied to thereby visualize the electrostatic image on the photosensitive drum.

Meanwhile, a recording medium P, such as a paper sheet or a plastic sheet, set inside a cassette 116 provided in a lower portion of an apparatus main body is fed by a pickup roller 117 and conveyed to a registration roller pair 115. Then, the recording medium P is conveyed from the registration roller pair 115 to the transferring nip portion at a timing at which the toner image formed on the photosensitive drum 102 reaches the transferring nip portion between the photosensitive drum 102 and the transfer roller 105. Then, a transfer voltage having a polarity (positive polarity in this embodiment) reverse to the toner is applied from a transfer voltage source 208 (see FIG. 4) to the transfer roller 105 being the transferring device, and the toner image formed on the photosensitive drum 102 is transferred onto the recording medium P.

Note that, there is a case where the toner adheres to the transfer roller 105 abutting against the photosensitive drum 102 when a jam occurs, and in order to return the adhering toner from the transfer roller 105 to the photosensitive drum 102, it is possible to apply a transfer voltage having the same polarity (negative polarity in this embodiment) as the toner from the transfer voltage source 208 to the transfer roller 105.

After the toner image is transferred onto the recording medium P as described above, the discharge is generated by the potential difference between a separation charge-eliminator 108 and the recording medium P to thereby eliminate charges from the recording medium charged to the positive polarity. As a result, the recording medium is electrostatically separated from the photosensitive drum 102, and is conveyed to the fixing device 109 along a recording-medium conveying direction "c".

The recording medium P conveyed to the fixing device 109 is heated and pressurized to have the toner image heat-fixed on the recording medium P, and is then delivered to a delivery part 113 provided in a upper portion of the apparatus by a delivery roller pair 119.

Further, as described later, the separation charge-eliminator 108 includes a charge-eliminating needle 108*a* formed of a thin-plate member made of metal and a charge-eliminating needle holder 301 made of a resin for holding the charge-eliminating needle 108*a* (see FIGS. 2A and 2B). Further, the separation charge-eliminator 108 is disposed in a position in proximity to the transfer roller (with the shortest distance between the surface of the transfer roller and a distal end of a separation charge-eliminating needle 108*a* being approximately 2 to 5 mm and being 3 mm in this embodiment) on the downstream side of the transfer roller in the recording-medium conveying direction in which the recording medium is conveyed to the photosensitive drum 102.

(Stain Detecting Structure of Separation Charge-Eliminator)

Next described will be a structure for determining the charge-elimination performance of the separation charge-eliminator 108 by detecting a stained state of the separation charge-eliminator which electrostatically peels off the recording medium on which the toner image has been transferred, from the photosensitive drum 102.

The separation charge-eliminator 108 is stained when flying toner or paper dust adheres to the separation charge-eliminator 108. The stain raises the electrical resistivity of the separation charge-eliminator 108 to cause current to be difficult to flow through the separation charge-eliminator 108. And hence the function of eliminating charges from the recording medium deteriorates in the separation charge-eliminator 108. Therefore, in this embodiment, it is determined how much toner adheres to the separation charge-eliminator 108 by detecting the current value of the current flowing through the separation charge-eliminator 108 by applying the charging voltage to the charging device or the transfer voltage to the transferring device. Then, the level of the charge-elimination performance of the separation charge-eliminator 108 is determined from the determined stained state of the separation charge-eliminator 108, and it is determined whether or not the separation charge-eliminator 108 needs to be changed or cleaned, a result of which is informed of on display.

In the image forming apparatus according to this embodiment, the separation charge-eliminator 108 is disposed on the downstream side along the recording-medium conveying direction "c" of a nip portion between the photosensitive drum 102 and the transfer roller 105 in contact with the photosensitive drum 102.

Figure 2A:
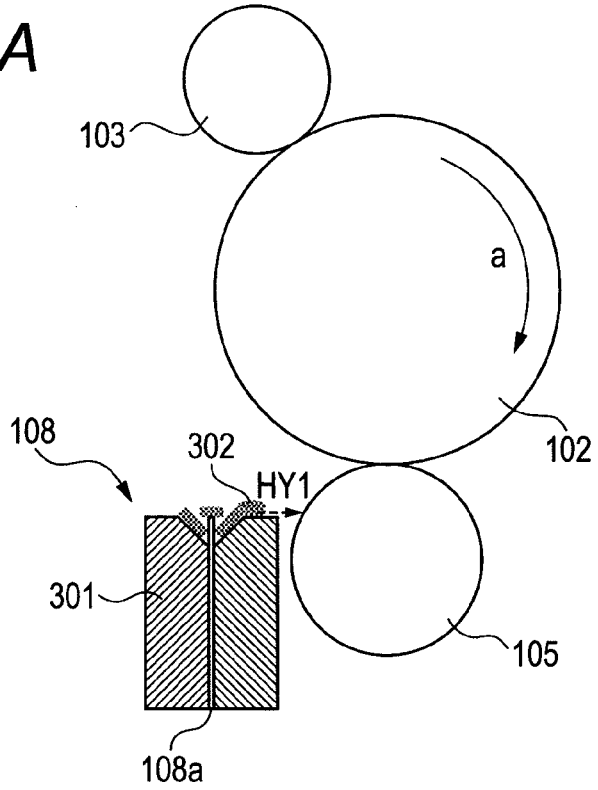
FIG. 2A is a partially enlarged sectional view of a periphery of a separation charge-eliminator.
Figure 2B:
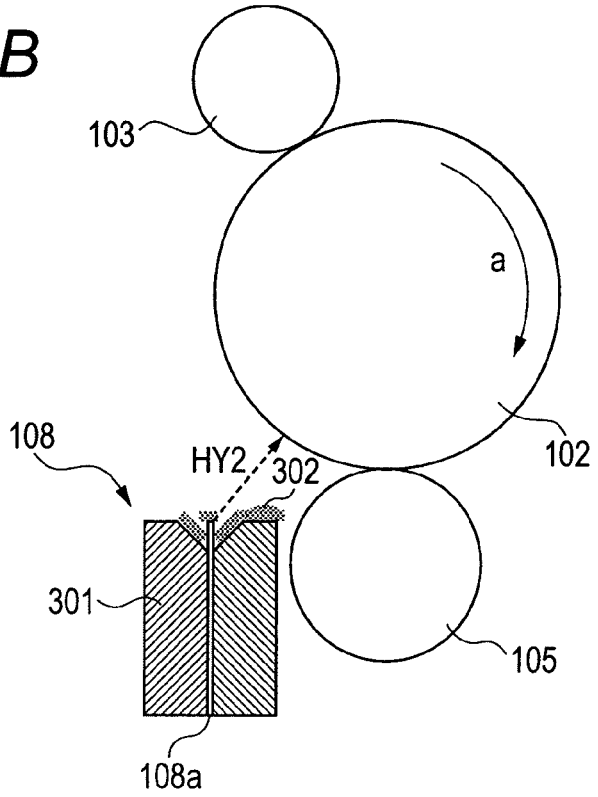
FIG. 2B is a partially enlarged sectional view of the periphery of the separation charge-eliminator.
Figure 3:
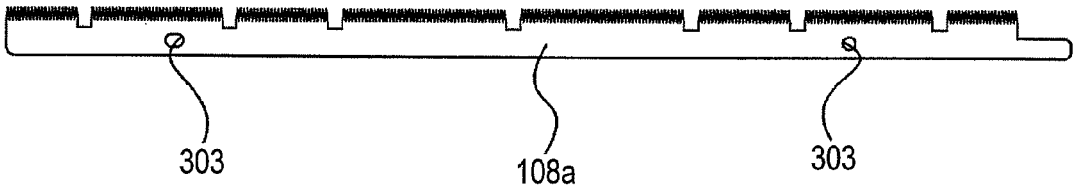
FIG. 3 is a diagram of a charge-eliminating needle of the separation charge-eliminator extending in a direction perpendicular to a recording-medium conveying direction.

FIG. 2A and FIG. 2B are partially enlarged sectional views of a periphery of the separation charge-eliminator 108 according to this embodiment. FIG. 3 is a single-component diagram of the charge-eliminating needle 108*a* of the separation charge-eliminator 108 according to this embodiment.

As illustrated in FIG. 3, a charge-eliminating needle that is a thin-plate material made of metal having a needle shape sharp at the distal end thereof is used as the charge-eliminating needle 108*a* of the separation charge-eliminator 108 according to this embodiment, in which screw holes 303 for fastening the charge-eliminating needle 108*a* to the charge-eliminating needle holder 301 by screws are formed. Further, in this structure, when the charging voltage is applied to the charging roller 103, the current is caused to flow from the photosensitive drum 102 into the needle-shaped distal end of the separation charge-eliminator 108 (distal end of the charge-eliminating needle 108*a*), which is located in a position opposite to the photosensitive drum 102, by a discharge phenomenon.

As illustrated in FIGS. 2A and 2B, the above-mentioned separation charge-eliminator 108 is disposed in the position spaced apart from the nip portion by 5 mm to 10 mm, downstream of the nip portion in the recording-medium conveying direction, and is disposed in the position in proximity to the transfer roller 105. In this structure, the shortest distance HY2 (second distance) between the distal end of the separation charge-eliminator 108 and the surface of the photosensitive drum 102 is longer than the shortest distance HY1 (first distance) between the distal end of the separation charge-eliminator 108 and the surface of the transfer roller 105. In this embodiment, the shortest distance HY1 is 3 mm, and the shortest distance HY2 is 6 mm.

(Relationship Between the Amount of Current Flowing Through Separation Charge-Eliminator and Paper Dust or the Like)

The amount of the current that is flowing through the separation charge-eliminator 108 by the discharge phenomenon when the charging voltage is applied to the charging roller 103 or the transfer voltage is applied to the transfer roller 105 varies depending on the adhesion of the paper dust or the toner to the separation charge-eliminator 108. Specifically, when paper dust or toner 302 flying inside the apparatus adheres to a periphery of the distal end of the separation charge-eliminator 108, the amount of a separation current flowing from the photosensitive drum 102 into the separation charge-eliminator 108 decreases compared with a case where there is no adhesion of paper dust or flying toner.

In other words, when the charging voltage is applied to the charging roller 103 to generate the discharge (corona discharge) between the photosensitive drum 102 and the distal end of the separation charge-eliminator 108 opposite to the photosensitive drum 102, and when high-resistance paper dust or toner exhibiting a surface resistance of approximately $1.0\times10^{10}$ to $1.0\times10^{13}\Omega$ adheres to the distal end of the separation charge-eliminator 108, it becomes difficult for the current to flow so that the amount of the current flowing from the photosensitive drum 102 into the separation charge-eliminator 108 is reduced. Based on the change in the current value, it is possible to detect the stained state of the distal end of the separation charge-eliminator 108.

Further, in the same manner, when paper dust or the toner 302 is piled up in a region (region along a surface of the charge-eliminating needle holder 301) between the transfer roller 105 and the charge-eliminating needle 108*a* held by the charge-eliminating needle holder 301, the amount of the separation current caused to flow from the transfer roller 105 into the separation charge-eliminator 108 by the discharge phenomenon decreases compared with the case where there is no adhesion of paper dust or toner.

In other words, the discharge generated between the transfer roller 105 and the separation charge-eliminator 108 located lateral to the transfer roller 105 when the transfer voltage is applied to the transfer roller 105 becomes a creeping discharge that extends from the transfer roller 105 through the surface of the charge-eliminating needle holder 301 to reach the charge-eliminating needle 108*a* protruding from the charge-eliminating needle holder 301. At this time, as described above, when electrically high-resistance paper dust or toner adheres to the charge-eliminating needle holder 301, it becomes difficult for current caused to flow from the transfer roller 105 into the separation charge-eliminator 108 by the discharge to flow and the current decreases.

In this embodiment, this phenomenon is used to estimate the amount of a foreign matter (such as paper dust or toner) adhering to the periphery of the distal end of the separation charge-eliminator and the amount of the foreign matter adhering to the periphery of the separation charge-eliminator.

Further described below with reference to FIGS. 2A and 2B is a relationship between the case where the transfer voltage is applied to the transfer roller 105 and the case where the charging voltage is applied to the charging roller 103 when foreign matter such as paper dust or the toner is piled up in the periphery of the separation charge-eliminator 108.

(Current Value of Current Flowing from Photosensitive Drum into Separation Charge-Eliminator)

First, by referring to FIG. 2B, such a phenomenon that the current is flowing through the separation charge-eliminator 108 when the charging voltage having the negative polarity is applied from the charging roller 103 will be described. Note that, use of this method enables estimation of a stain amount in the periphery of the distal end of the separation charge-eliminator 108.

The current value (first detected current value) of a current caused to flow from the photosensitive drum 102 into the distal end of the separation charge-eliminator 108 by the discharge when the charging voltage is applied becomes larger as the amount of the paper dust or the like adhering to the separation charge-eliminator 108 decreases and becomes smaller as the amount of the adhering paper dust or the like increases. This is because, as described above, the electric resistance of the separation charge-eliminator 108 becomes higher as more paper dust or the like adheres to the separation charge-eliminator 108. Here, the charging voltage to be applied is the same voltage (in this embodiment, DC −550 V and AC 1,300 V) as that used in the image formation.

Accordingly, detection of the current caused to flow from the photosensitive drum 102 into the distal end of the separation charge-eliminator 108 by the discharge phenomenon enables the estimation of the stain amount in the periphery of the distal end of the separation charge-eliminator 108. At this time, when the transfer voltage having the positive polarity is applied to the transfer roller 105, not only the current caused to flow from the photosensitive drum 102 into the separation charge-eliminator 108, but also the current caused to flow from the transfer roller 105 into the separation charge-eliminator 108 is generated, which inhibits the first detected current value from being measured with accuracy. For this reason, when the first detected current value is measured, the transfer voltage is not applied to the transfer roller 105 so as to avoid the discharge from being generated between the transfer roller 105 and the separation charge-eliminator 108.

(Current Value of Current Caused to Flow from Transfer Roller into Separation Charge-Eliminator)

Next, by referring to FIG. 2A, the case where the transfer voltage having the positive polarity is applied to the transfer roller 105 will be described. The use of this method enables the estimation of the stain amount in the periphery of the separation charge-eliminator.

The current value (second detected current value) of a current flowing through the separation charge-eliminator 108 when the transfer voltage is applied also becomes larger as the amount of paper dust or the like adhering to the region (region along the surface of the charge-eliminating needle holder 301) between the transfer roller 105 and the charge-eliminating needle 108*a* of the charge-eliminating needle holder 301 decreases and becomes smaller as the amount of adhering paper dust or the like increases. This is because, as described above, the adhesion of paper dust or the like exhibiting a high electric resistance causes it to be difficult for the current to flow.

Accordingly, an inflowing amount of the current caused to flow from the transfer roller 105 into the separation charge-eliminator 108 enables the estimation of the stain amount in the periphery of the separation charge-eliminator. Here, the transfer voltage to be applied is the same voltage (in this embodiment, DC 500 V) as that used in the image formation.

At this time, when the charging voltage is applied to the charging roller 103, there is a fear that not only the current caused to flow from the transfer roller 105 into the separation charge-eliminator 108, but also the current flowing from the photosensitive drum 102, to which the charging voltage is applied, into the separation charge-eliminator 108 may be generated, and generation of the inflowing current inhibits the second detected current value from being measured with accuracy. For this reason, when the second detected current value is measured, the charging voltage is not applied to the photosensitive drum 102 so as to avoid the discharge from being generated between the photosensitive drum 102 and the separation charge-eliminator 108.

From the above description, in the image forming apparatus according to this embodiment, the above-mentioned phenomenon is converted into numerical values, which is created as a threshold table, and when the charging voltage or the transfer voltage in each environment is applied, a comparison is performed between the current value of the current flowing through the separation charge-eliminator 108 and the current value listed in the threshold table. When the current value of the current flowing through the separation charge-eliminator 108 becomes smaller than a threshold value listed in the threshold table, it is determined that a large amount of toner flying inside the apparatus or a large amount of paper dust or the like has adhered to the periphery of the separation charge-eliminator 108. In the case of this embodiment, when the first and second detected current values become smaller than values set as respective threshold values thereof, there is a fear that separation performance may deteriorate, and hence information that prompts a user to change or clean the separation charge-eliminator is provided to the user.

(Block Diagram of Stain Detection)

Figure 4:
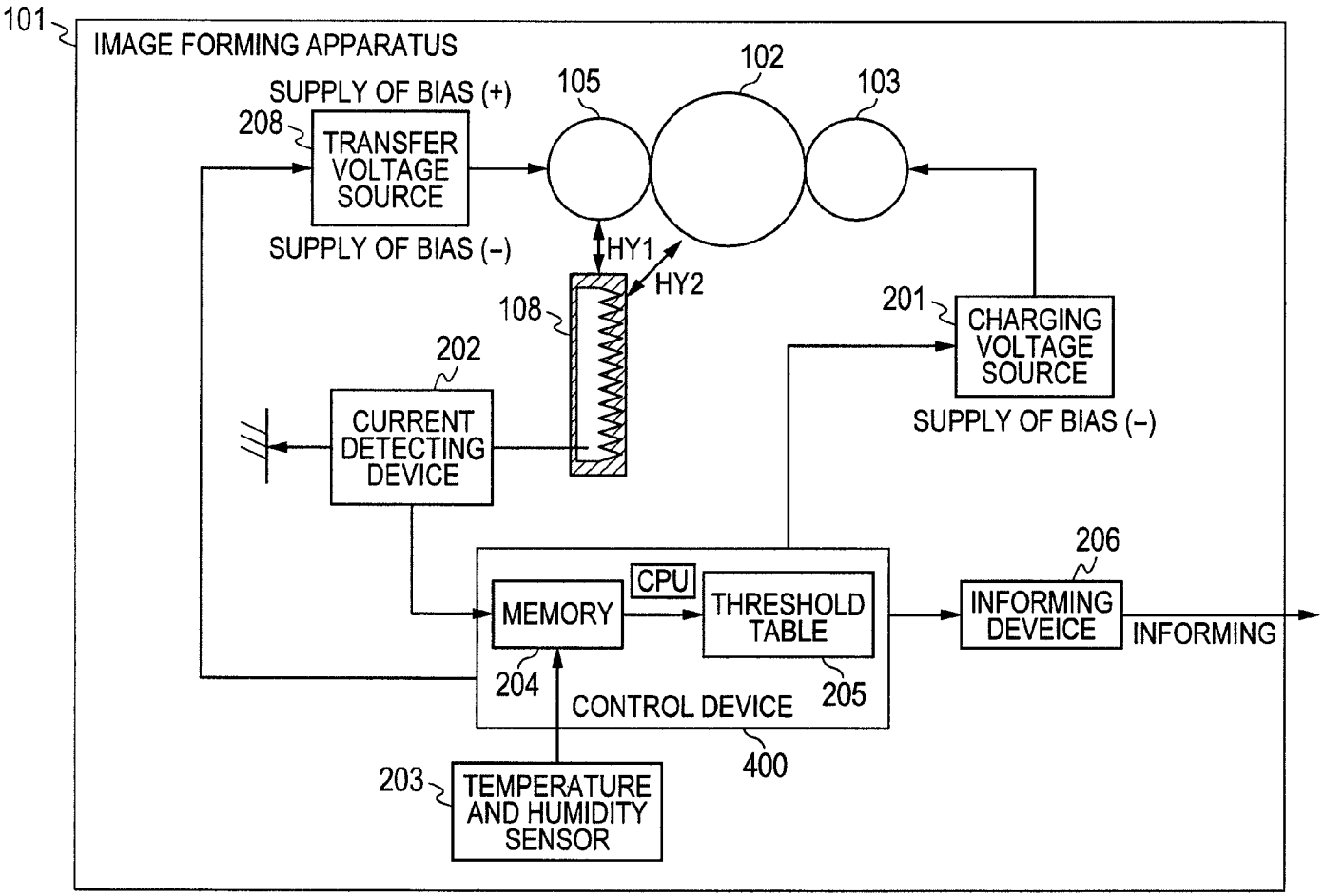
FIG. 4 is a block diagram illustrating a stain detecting structure for the separation charge-eliminator used in a first embodiment.

FIG. 4 is a block diagram illustrating a structure of the image forming apparatus 101 according to this embodiment for realizing the above-mentioned operation.

As illustrated in FIG. 4, a CPU included in a control device 400 controls the charging voltage applied from a charging voltage source 201 to the charging roller 103, and controls the transfer voltage applied from the transfer voltage source 208 to the transfer roller 105. In this structure, the current flowing through the grounded separation charge-eliminator 108 is detected by a current detecting device 202. The current value detected by the current detecting device 202 is stored in a memory 204 included in the control device 400.

In this embodiment, a temperature and humidity sensor 203 (environment detecting device) that combines a temperature detecting device which detects a temperature inside the main body of the image forming apparatus 101 and a humidity detecting device which detects the relative humidity is provided, and a threshold table 205 is segmented in accordance with the detected temperature and relative humidity inside the apparatus and threshold values are set for respective segments.

If two kinds of numerical value, that is, the first detected current value detected by the current detecting device 202 when the charging voltage is applied and the second detected current value detected by the current detecting device 202 when the transfer voltage is applied each become smaller than each of the set threshold values, a control signal is output from the CPU included in the control device 400 to an informing device 206 provided in the operation unit, to perform such display as to prompt the user to change or clean the separation charge-eliminator 108.

(Threshold Table)

Here, FIG. 5 shows an example of the threshold table used in this embodiment. Note that, in this embodiment, the threshold table is set in consideration of the apparatus environment, in particular, the humidity inside the apparatus. This is because the amount of water becomes larger at the higher humidity inside the apparatus than at the lower humidity, thereby causing the current to be easy to flow into the separation charge-eliminator 108 even with the same applied voltage. Therefore, as shown in FIG. 5, the threshold values are sorted by three categories of a case (HH environment) where the temperature and the humidity are high inside the apparatus, a normal case (NN environment), and a low case (NL environment), and the threshold values are set for respective categories. Here, in the case (HH environment) where the temperature and the humidity are high inside the apparatus in this embodiment, the temperature is set to equal to or greater than 30° C. and the relative humidity is set to equal to or greater than 80% RH (equal to or greater than absolute amount of water vapor of 16 kg/kgD.A.). Further, in the low case (NL environment), the temperature is set to less than 23° C. and the relative humidity is set to less than 50% RH (equal to or less than absolute amount of water vapor of 2 kg/kgD.A), while in the other environment is set as the normal case (NN environment) (absolute amount of water vapor of 2 to 16 kg/kgD.A).

In the case where the environment inside the apparatus is the HH environment, when the current value (first detected current value) detected by the current detecting device 202 when the charging voltage is applied becomes equal to or less than −4 μA (first threshold value), and when the current value (second detected current value) detected by the current detecting device 202 when the transfer voltage is applied becomes equal to or less than +8 μA (second threshold value), it is determined that the separation charge-eliminator 108 needs to be cleaned or changed. Note that, the "+" sign means that the flowing direction of the current is from the photosensitive drum 102 or the transfer roller 105 to the separation charge-eliminator 108, while the "−" sign means that the flowing direction is from the separation charge-eliminator 108 to the photosensitive drum 102 or the transfer roller 105.

In the same manner, in the case where the environment inside the apparatus is the NN environment, when the first detected current value becomes equal to or less than −3 μA and when the second detected current value becomes equal to or less than +5 μA, and in the case where the environment inside the apparatus is the NL environment, when the first detected current value becomes equal to or less than −1 μA and when the second detected current value becomes equal to or less than +2 μA, it is determined that the separation charge-eliminator 108 needs to be cleaned or changed.

Note that, in this embodiment, the threshold value of a separation current amount corresponding to the stain amount of the separation charge-eliminator 108 is set by using the threshold table. Here, the threshold value corresponding to the first detected current value is the first threshold value, and the threshold value corresponding to the second detected current value is the second threshold value.

(Stain Amount of Separation Charge-Eliminator)

Next, the stain amount of the separation charge-eliminator 108 will be described.

First, a description will be provided of a measurement method of measuring the amount of toner or paper dust adhering to the vicinity of the separation charge-eliminator 108. For example, a fluorescent X-ray analysis apparatus ("XGT-5000" manufactured by HORIBA, Ltd.) is used to measure a substance (Ti is measured in the present invention) included in the toner at 20 points in total which are obtained by dividing a length of the vicinity of the separation charge-eliminator 108 into five and rotating the respective points in the circumferential direction by 90° four times. The XGT-5000 is set to have an applied voltage of 30 kV, a current of 0.16 mA, and a measurement time of 100 seconds. Further, the value output by the fluorescent X-ray analysis apparatus is expressed in cps (counts per second), and the large value of cps means that the stain amount is also large.

In view of the stain amount, the first and second threshold values corresponding to the first and second detected current values are set to thereby suppress the separation failure and reduce the influence on image quality.

(Stain Detecting Procedure)

Figure 6:
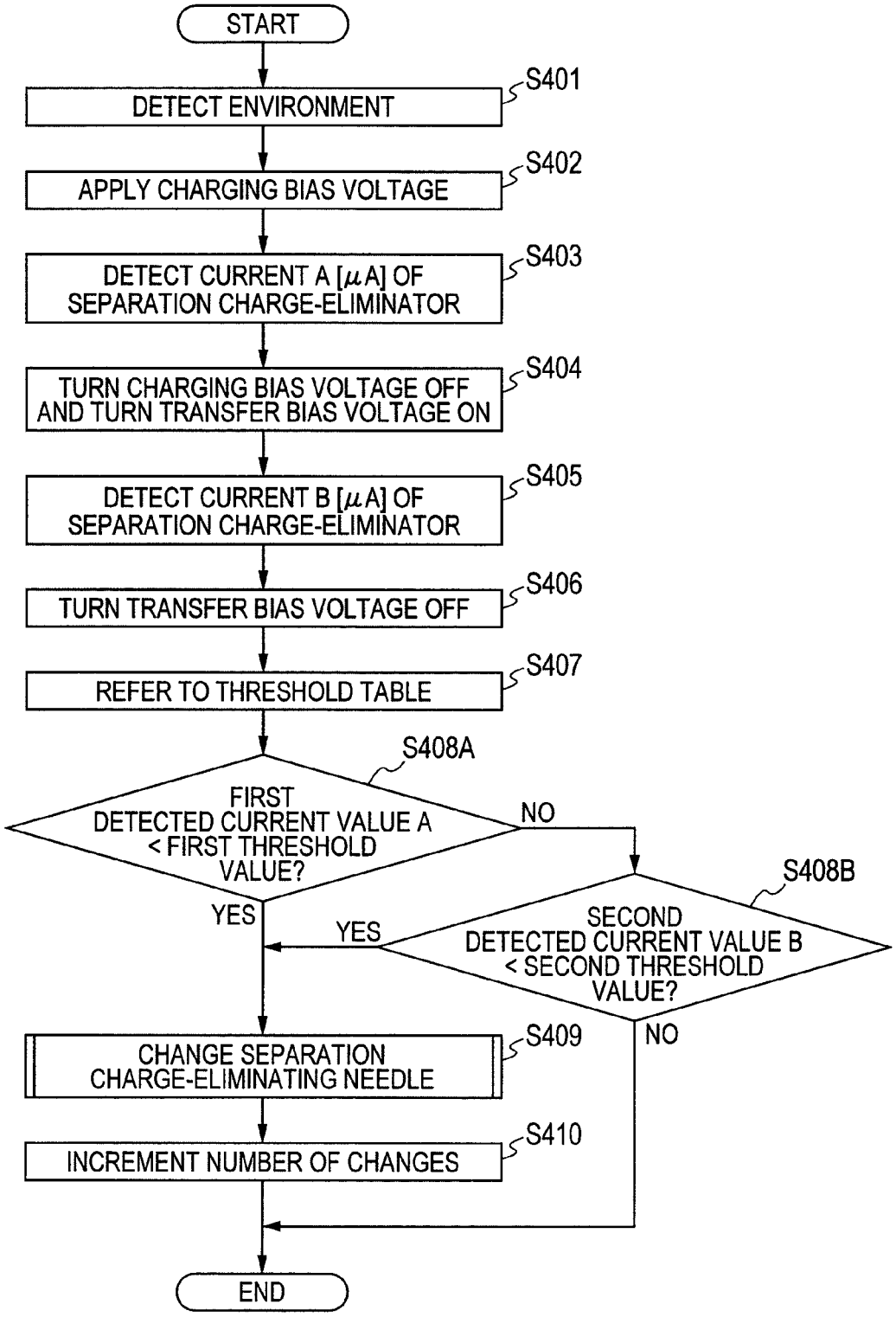
FIG. 6 is a flowchart illustrating a change informing procedure for the separation charge-eliminator.

Next, by referring to FIG. 6, stain-detection control for the separation charge-eliminator 108 will be described. FIG. 6 is a flowchart illustrating a procedure of the stain detection control for the separation charge-eliminator 108. This processing is realized by the CPU (FIG. 4) in the control device 400 reading and executing a control program stored in the memory 204. Note that, the stain-detection control is performed before a printing operation of forming the image onto the recording medium.

Hereinafter, the stain-detection control will be described. First, the CPU causes the temperature and humidity sensor 203 to detect the environment inside the apparatus (S401), and causes the current detecting device 202 to detect the first detected current value obtained when the same voltage (in this embodiment, DC −550 V and AC 1,300 V) as that used in the image formation is applied from the charging voltage source 201 to the charging device 103 (S402 and S403). Subsequently, the charging voltage is turned OFF or the charging voltage lower than that used in the image formation is applied, and the same voltage (in this embodiment, DC 500 V) as that used in the image formation is applied from the transfer voltage source 208 to the transfer roller 105 (S404). The second detected current value of the current that is flowing through the separation charge-eliminator 108 when the transfer voltage is applied is detected, and the transfer voltage is turned OFF (S405 and S406).

As described above, control is facilitated by having the CPU apply the same voltage as that used in the image formation even in stain detection. Note that, a voltage dedicated to the stain detection for the separation charge-eliminator, which is different from that used in the image formation, may be applied in the stain detection. For example, a DC of −2,000 V and an AC of 1,300 V are applied from the charging voltage source 201 in order to detect the first detected current value, and a DC of +2,000 V is applied from the transfer voltage source 208 in order to detect the second detected current value. In this manner, by applying the voltage dedicated to the stain detection, the potential difference between the photosensitive drum 102 or the transfer roller 105 and the separation charge-eliminator 108 can be controlled to detect the detected current with high accuracy.

Further, the transfer voltage is turned OFF when the CPU detects the first detected current value in order to, as described above, avoid the discharge from being generated between the transfer roller 105 and the separation charge-eliminator 108. However, the transfer voltage is not necessarily turned OFF. For example, when the charging voltage is applied, without applying a voltage to the transfer roller 105, the voltage is applied to the transfer roller 105 to some extent due to the influence of the charging voltage. At this time, in a case where such a transfer voltage as to reduce the potential difference between the transfer roller 105 and the separation charge-eliminator 108 is applied, the discharge between the transfer roller 105 and the separation charge-eliminator 108 is suppressed with reliability to allow the detection of the first detected current with accuracy. In the same manner, the charging voltage is not necessarily turned OFF when the CPU detects the second detected current value, and such a charging voltage as to reduce the potential difference between the photosensitive drum 102 and the separation charge-eliminator 108 may be applied. In other words, when the CPU detects the first detected current value, the charging voltage and the transfer voltage may be set so that a discharge amount between the photosensitive drum 102 and the separation charge-eliminator 108 becomes larger than the discharge amount between the transfer roller 105 and the separation charge-eliminator 108. In the same manner, when the CPU detects the second detected current value, the charging voltage and the transfer voltage may be set so that the discharge amount between the transfer roller 105 and the separation charge-eliminator 108 becomes larger than the discharge amount between the photosensitive drum 102 and the separation charge-eliminator 108.

Subsequently, the CPU refers to the threshold table (S407) to change processing depending on the current environment (temperature and humidity). When the first detected current value is smaller than the first threshold value (S408A) or when the first detected current value is equal to or greater than the first threshold value with the second detected current value being smaller than the second threshold value (S408B), the CPU outputs a predetermined control signal to the informing device 206 to cause the informing device 206 to issue the message to prompt the user to change the separation charge-eliminator 108 (S409). After that, the CPU increments a counted number of changes that is stored in a predetermined area within the memory 204 (S410).

On the other hand, when the first detected current value is equal to or greater than the first threshold value with the second detected current value being equal to or greater than the second threshold value (S408B), the CPU returns to a standby state without change.

As described above, in the image forming apparatus according to this embodiment, the CPU detects the respective current values of the current flowing through the separation charge-eliminator 108 when the charging voltage and the transfer voltage in the respective environments are applied, and when the current value indicating a deteriorated separation performance is detected, the CPU determines that the periphery of the separation charge-eliminator 108 is stained with the paper dust or the like.

Accordingly, with regard to the stain detection for the separation charge-eliminator, the first detected current value that exhibits the smaller current value as the distal end of the separation charge-eliminator 108 becomes stained to the larger extent and the second detected current value that exhibits the smaller current value as a periphery of the charge-eliminating needle holder becomes stained to the larger extent are used and compared with the set threshold values, respectively, which allows the stain of the separation charge-eliminator 108 to be detected with more accuracy than in the case where the stain is determined simply based on the current value (second detected current value) of the current caused to flow when the transfer voltage is applied.

Further, the message that prompts the user to change the separation charge-eliminator 108 integral with the charge-eliminating needle holder 301 can be issued at a timing suitable for the recording medium used by the user or the environment. Accordingly, compared with a case where the separation charge-eliminator 108 is changed regularly, the changing can be performed at an appropriate time, which produces an effect of an improvement in change efficiency.

Note that, the description has been provided according to the embodiment in which the informing device is provided in the printer body, but the informing can be performed in the same manner even in a case in which the informing means is provided in the PC.

Second Embodiment

Next, by referring to FIGS. 7A to 7C to FIG. 11, an apparatus according to a second embodiment will be described. Note that, the apparatus according to this embodiment has the same structure as the above-mentioned first embodiment, a duplicate description of which is omitted. Here, the cleaning structure for the separation charge-eliminator which is a feature of this embodiment will be described.

In the above-mentioned first embodiment, if a separation current value obtained when the charging voltage and the transfer voltage are applied exceeds a predetermined threshold value, the control signal is output from the CPU in the control device to the informing device to provide predetermined information from the informing device based on the control signal. Meanwhile, the second embodiment is directed to an example of cleaning the separation charge-eliminator.

Figure 7A:
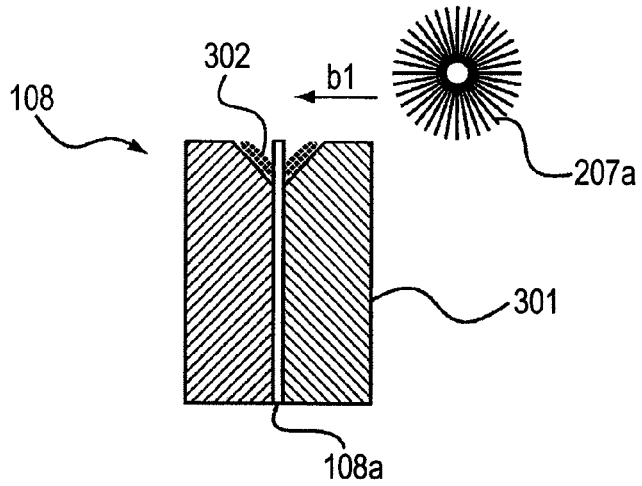
FIG. 7A is an explanatory diagram of an operation of a cleaning device which cleans the separation charge-eliminator.
Figure 7B:
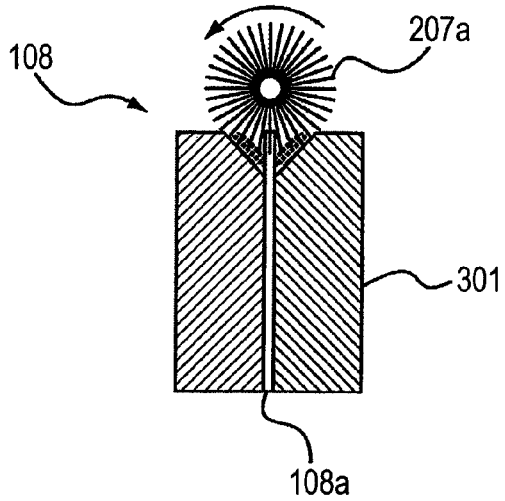
FIG. 7B is an explanatory diagram of the operation of the cleaning device which cleans the separation charge-eliminator.
Figure 7C:
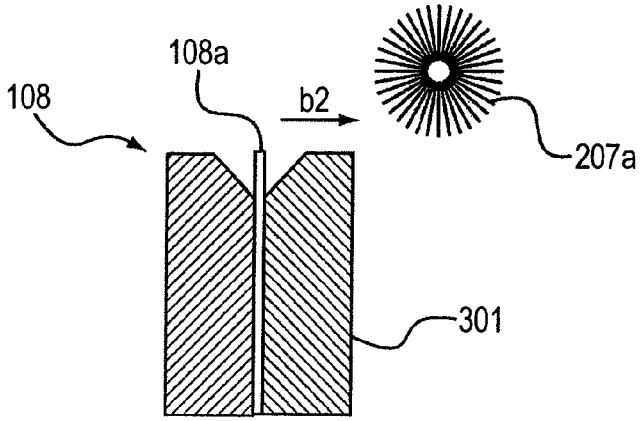
FIG. 7C is an explanatory diagram of the operation of the cleaning device which cleans the separation charge-eliminator.

In this embodiment, a cleaning device 207 which cleans the separation charge-eliminator 108 is provided. As illustrated in FIGS. 7A to 7C, the cleaning device is provided with a rotation brush 207*a* having substantially the same length as the length in the longitudinal direction of the separation charge-eliminator 108 protruding from the charge-eliminating needle holder 301 so as to be rotatable as a cleaning member which cleans the separation charge-eliminator 108. Further, the rotation brush 207*a* is provided so as to be enabled to move between a standby position and a cleaning position by a drive mechanism (not shown).

The cleaning device 207 is structured as follows. When a cleaning signal is sent out from the control unit, the rotation brush 207*a* located in the standby position is caused to move in the direction indicated by the arrow "b1" of FIG. 7A to reach the cleaning position. As illustrated in FIG. 7B, the rotation brush 207*a* is caused to rotate while being in contact with the separation charge-eliminator 108 to thereby remove paper dust or the like adhering to the separation charge-eliminator 108. When the cleaning is finished, the cleaning member 207*a* is caused to move in the direction indicated by the arrow "b2" of FIG. 7C to return to the standby position.

As described above, by providing the separation charge-eliminator 108 with a cleaning mechanism, a usable period can be extended without changing the separation charge-eliminator 108. In addition, a structure that allows the cleaning member to be changed can further extend the usable time period of the separation charge-eliminator 108.

Figure 8:
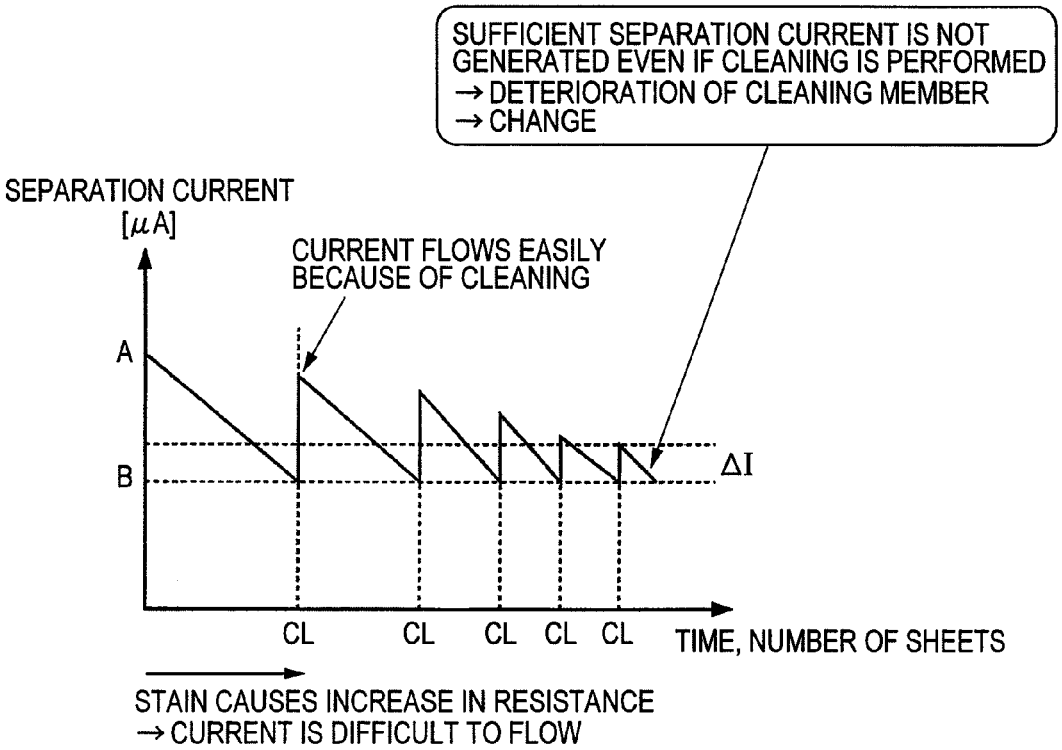
FIG. 8 is a graph illustrating a relationship between separation current values before and after the separation charge-eliminator is cleaned.

FIG. 8 is an example of a graph illustrating the relationship between a timing at which the separation charge-eliminator 108 is cleaned by the cleaning member 207*a* and a discharge current value obtained when the charging voltage is applied.

As described above, as the number of printed sheets increases, the periphery of the separation charge-eliminator 108 is stained with more paper dust or the like, and the electric resistance of the separation charge-eliminator 108 increases, which decreases the current caused to flow when the charging voltage is applied.

In the above-mentioned first embodiment, the notification that prompts the changing of the separation charge-eliminator 108 is issued when the first detected current value and the second detected current value exceed the first and second threshold values set in the threshold table, while in this embodiment, the cleaning device 207 is operated to clean the separation charge-eliminator 108 instead of prompting the changing. When the separation charge-eliminator 108 is cleaned, the paper dust or the like is removed from the separation charge-eliminator 108, which reduces the electric resistance to a lower level than before the cleaning. For this reason, in the case of applying the same charging voltage, the flowing current becomes larger than before the cleaning.

However, the cleaning member becomes stained little by little as the cleaning is repeated, which deteriorates the cleaning performance of the cleaning member. Hence, as illustrated in FIG. 8, as the frequency of the cleaning (CL) increases, a return level of the current caused to flow after the cleaning becomes smaller to finally produce no cleaning effect.

Therefore, this embodiment is structured as follows. As described above, the separation charge-eliminator is repeatedly cleaned each time the first detected current value and the second detected current value exceed the set threshold values, and each time the cleaning is performed, a comparison is performed between the first detected current value flowing through the separation charge-eliminator when the charging voltage is applied before the cleaning and the first detected current value flowing through the separation charge-eliminator when the charging voltage is applied after the cleaning. When a variation between the current values before and after the cleaning is equal to or less than a third threshold value, it is determined that the cleaning member 207*a* has reached its end of life, and the control signal is output from the CPU included in the control device to the informing device which inform the user to prompt the user to change the cleaning member based on the control signal.

Figure 9:
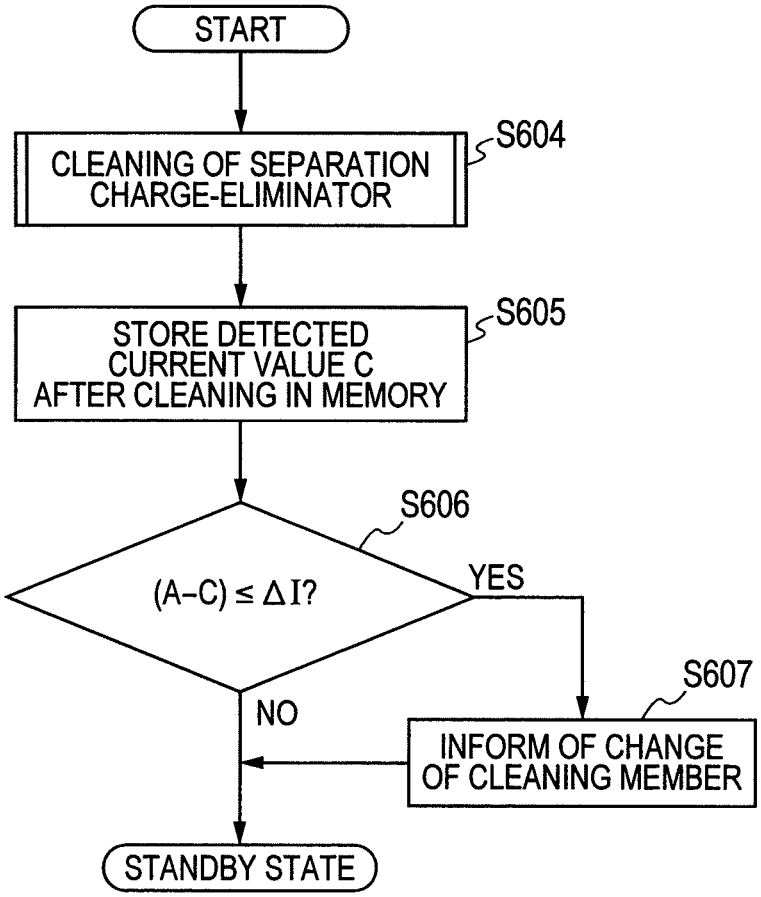
FIG. 9 is a flowchart illustrating a change informing procedure for a cleaning member according to a second embodiment.
Figure 10:
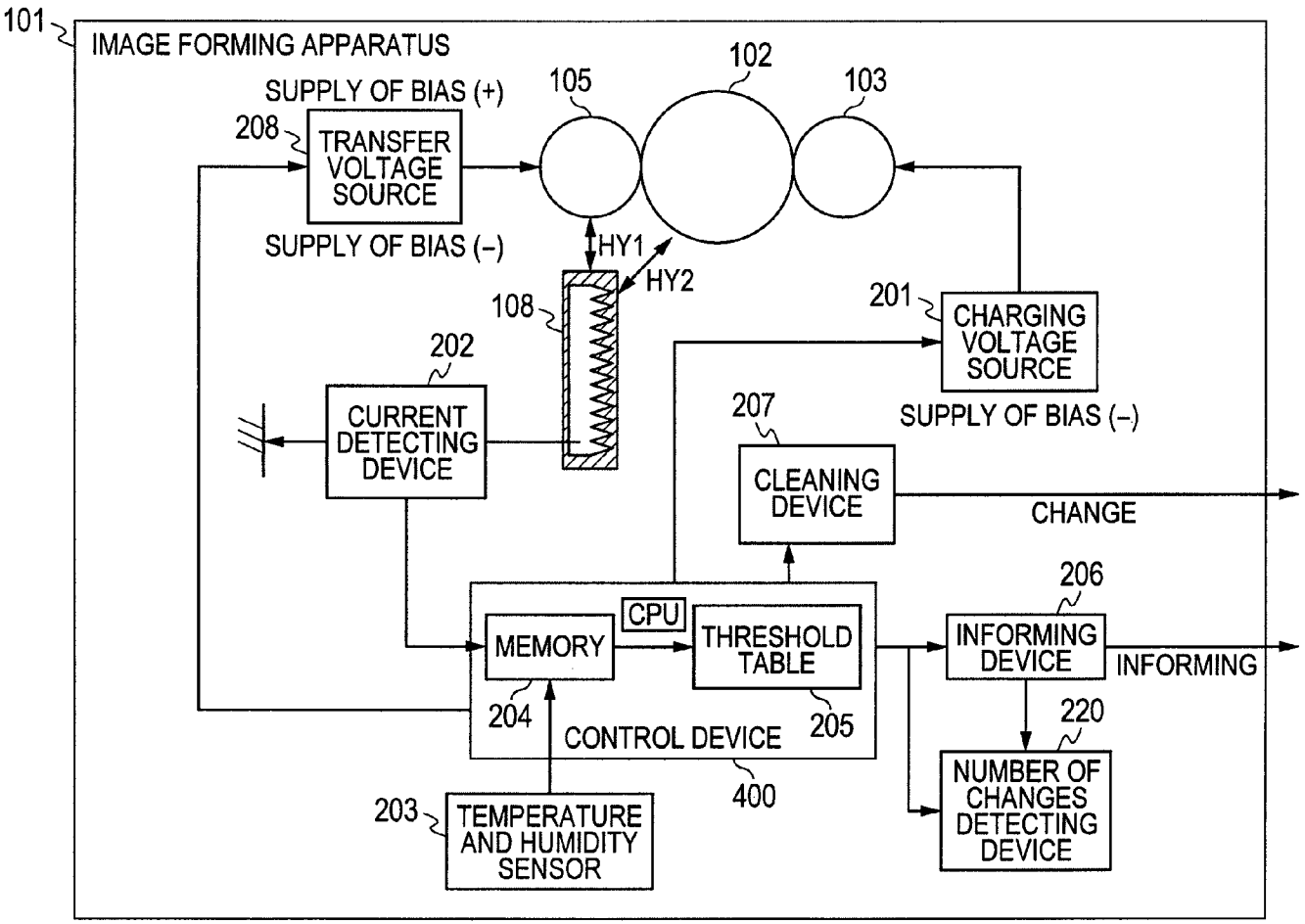
FIG. 10 is a block diagram illustrating a stain detecting structure for a separation charge-eliminator used in the second embodiment.
Figure 11:
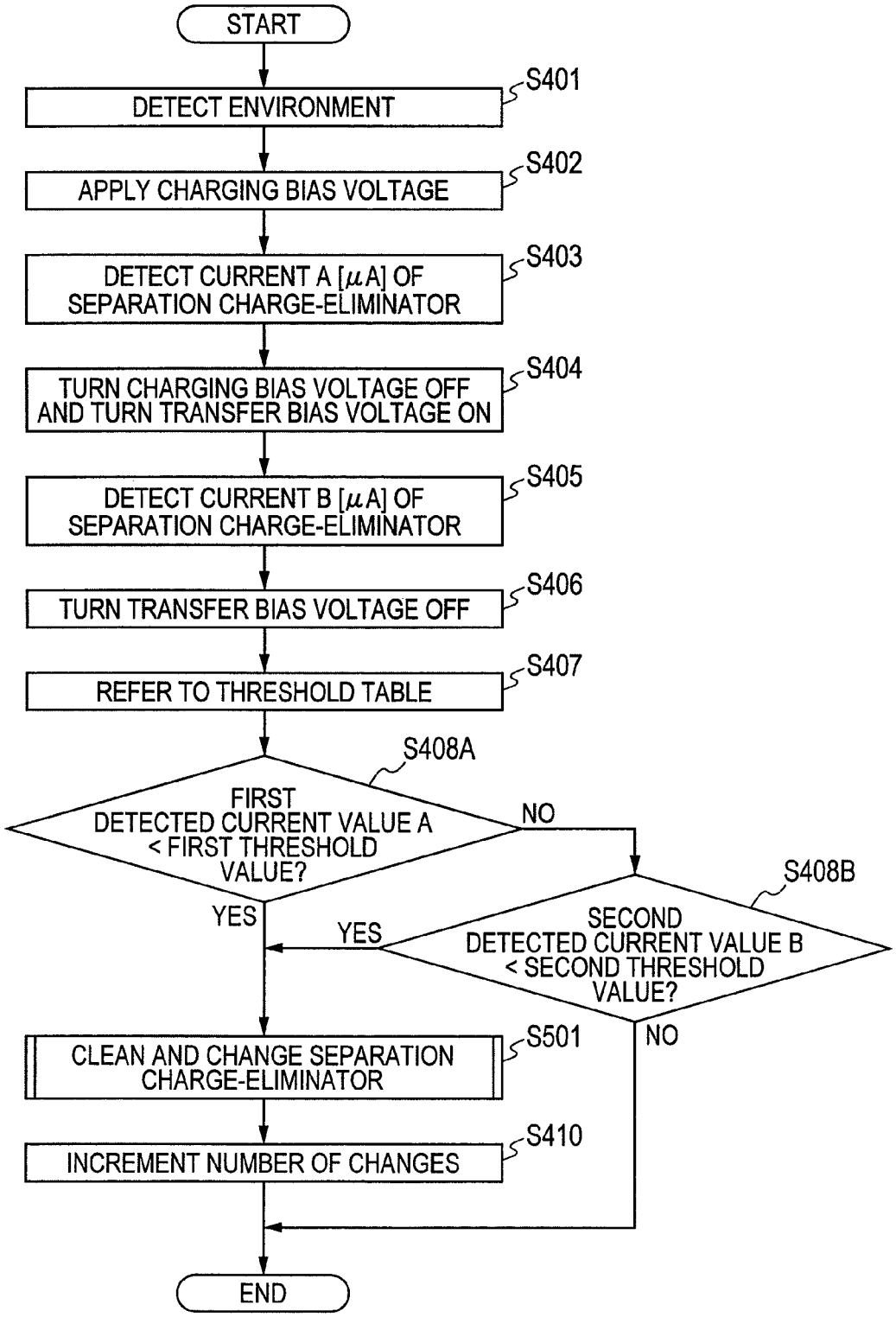
FIG. 11 is a flowchart illustrating a cleaning operation procedure for the separation charge-eliminator according to the second embodiment.

FIG. 9 and FIG. 11 are flowcharts illustrating a cleaning operation procedure for the separation charge-eliminator according to the second embodiment. FIG. 10 is a block diagram illustrating the structure of the image forming apparatus 101 according to this embodiment for realizing the operation performed along the flowcharts. In the structure of this embodiment, components having the same functions as those of the above-mentioned first embodiment are denoted by the same reference numerals, duplicate descriptions of which is omitted, and here, components different from those of the above-mentioned embodiment will be described.

First, by referring to FIG. 9 and FIG. 11, the cleaning operation procedure for the separation charge-eliminator will be described. This processing is realized by having the CPU (FIG. 10) included in the control device 400 read and execute the control program stored in the memory 204. Note that, a duplicate description of the same parts as the processing described in the above-mentioned first embodiment is omitted. Hence, by referring to FIG. 9, a cleaning operation (S501) illustrated in FIG. 11 will be described.

The CPU cleans the separation charge-eliminator 108, then applies the charging voltage, detects a current value (first detected current value) C of the current flowing through the separation charge-eliminator 108, and stores the current value C in the memory (S604 and S605). In a case where a difference (A−C) between the current values before and after the cleaning is equal to or less than the third threshold value (ΔI) (for example, the difference is 2 μA), it is determined that the cleaning member has reached the end of its life, thereby exhibiting a deterioration of its cleaning performance, and the CPU outputs the control signal to the informing device to cause the informing device to inform, based on the control signal, the user of the promotion that the cleaning member is to be changed (S606 and S607).

As described above, when it is determined that the cleaning performance of the cleaning member 207*a* has deteriorated by performing the comparison between the current values of the current flowing through the separation charge-eliminator 108 before and after the cleaning, the user is informed of the need to change the cleaning member. Accordingly, even if the user uses the recording medium that generates a large amount of paper dust, without having to detect the type of recording medium and perform complicated separation control or the like in the apparatus main body, an appropriate separation charge-elimination performance can be maintained in the main body.

Note that, this embodiment is described by taking the example in which the separation charge-eliminator is automatically cleaned by the cleaning device when it is determined that the separation charge-eliminator is stained. However, instead of the structure for the automatic cleaning, the informing device may inform the user that the separation charge-eliminator needs to be cleaned when it is determined that the separation charge-eliminator is stained, to thereby cause the user to manually operate the cleaning device for the cleaning.

Further, the number of changes of the separation charge-eliminator or the cleaning member may be counted and stored, and the detection of the life of the apparatus may be enabled based on the number of changes.

For this reason, as illustrated in FIG. 10, a number of changes detecting device 220, which detects the number of changes of the separation charge-eliminator or the cleaning member, is provided. When the first detected current value and the second detected current value exceed the first and second threshold values, as described above, the informing device informs the user to prompt the user to change the separation charge-eliminator 108 or the cleaning member 207*a*. At this time, the paper dust or the like is removed from the separation charge-eliminator 108 when the separation charge-eliminator 108 is changed or when the cleaning member 207*a* is changed to clean the separation charge-eliminator 108, the first detected current value and the second detected current value are again below the first and second threshold values.

Therefore, while the informing device is informing the user so as to prompt the changing of the separation charge-eliminator or the cleaning member, when the first detected current value and the second detected current value again become below the first and second threshold values, the number of changes detecting device 220 detects that the separation charge-eliminator or the cleaning member is changed one time.

Further, in a case where the number of changes is large (for example, equal to or greater than 10 times), when the number of changes becomes equal to or greater than a predetermined number of times, the informing device informs the user that the apparatus has reached the end of its life.

This enables the stain to be detected inside the apparatus main body and the life of the apparatus to be detected without providing a mechanism such as a special sensor inside the apparatus main body.

Third Embodiment

Next, an apparatus according to a third embodiment will be described. Note that, the apparatus according to this embodiment has the same structure as the above-mentioned first embodiment, duplicate description of which is omitted. Here, components different from those of the above-mentioned embodiments are described.

The above-mentioned first embodiment is described by taking the example in which the cleaning is performed when the separation charge-eliminator 108 is stained. However, the periphery of the distal end of the separation charge-eliminator 108 has a needle shape, and hence the cleaning of the distal end part may impair the function of the separation charge-eliminator 108 due to a deformed needle. Therefore, in this embodiment, when paper dust or the toner adheres to the separation charge-eliminator 108, the display is changed between a case of prompting the user or a service person to perform the cleaning and a case of prompting the changing of the separation charge-eliminator, according to the position in which the separation current flowing through the separation charge-eliminator 108 exceeds the threshold value.

Further, the above-mentioned first embodiment is described by taking the example in which the separation charge-eliminator 108 is grounded, while in this embodiment, a charge-eliminating voltage having a negative polarity is applied to the separation charge-eliminator 108 in the charge elimination for the recording medium during the image formation or in the stain detection for the separation charge-eliminator 108. The control operation in the case where the charge-eliminating voltage is applied is more complicated than the control operation in the case where the separation charge-eliminator 108 is grounded, but the potential difference is easy to set for causing the discharge between the photosensitive drum and the separation charge-eliminator or between the transfer roller and the separation charge-eliminator. Here, the charge-eliminating voltage to be applied is the same voltage (in this embodiment, DC −2,000 V) as that used in the image formation, and the charging voltage and the transfer voltage are the same voltages (in this embodiment, DC −550 V and AC 1,300 V, and DC 500 V) as those used in the image formation in the same manner as in the above-mentioned first embodiment.

Further, in this embodiment, the voltage is applied in the stain detection for the separation charge-eliminator 108 in order to prevent a memory phenomenon from occurring on the photosensitive drum 102.

In other words, also in this embodiment, in order to determine the stained state of the separation charge-eliminator, the first detected current value is detected by the current detecting device by applying the charging voltage to the charging roller 103 without applying the transfer voltage to the transfer roller 105, and the second detected current value is detected by the current detecting device by applying the transfer voltage to the transfer roller 105, thereby detecting the stain caused on the separation charge-eliminator 108. When the photosensitive drum 102 is left positively charged due to the application of the transfer voltage by applying the transfer voltage having the positive polarity to the transfer roller 105 in order to detect the second detected current value, there is a fear of causing a so-called memory phenomenon in which the photosensitive drum 102 cannot be negatively charged satisfactorily in the charging performed when the next image is formed.

Therefore, in this embodiment, in order to prevent the memory phenomenon, in the case of detecting the second detected current value, the transfer voltage is applied while not only the transfer voltage but also the charging voltage is applied.

As described above, even if the charging voltage is applied to negatively charge the photosensitive drum in order to prevent the memory phenomenon from occurring on the photosensitive drum 102, the transfer voltage is +500 V having the reversed polarity compared with the separation charge-eliminating voltage of −2,000 V having the negative polarity, and hence the potential difference between the transfer roller 105 and the separation charge-eliminator 108 is 2,500 V, which is satisfactorily larger than the potential difference of 1,500 V between −500 V of the charged photosensitive drum 102 having the negative polarity and the separation charge-eliminating voltage of −2,000 V. In addition, the distance between the transfer roller 105 and the distal end of the separation charge-eliminator 108 is 3 mm as described above, which is smaller than the distance of 6 mm between the photosensitive drum 102 and the distal end of the separation charge-eliminator 108 as described above.

In this manner, in the relationship between the photosensitive drum 102 and the separation charge-eliminator 108, the potential difference is smaller and the distance is longer than in the relationship between the transfer roller 105 and the separation charge-eliminator 108. For this reason, the current flowing from the photosensitive drum 102 to which the charging voltage has been applied in order to prevent the memory phenomenon into the separation charge-eliminator 108 has a satisfactorily small value, and the second detected current value of the current caused to flow from the transfer roller 105 into the separation charge-eliminator 108, which is to be obtained, can be detected with high accuracy.

(Block Diagram of Stain Detection)

Figure 12:
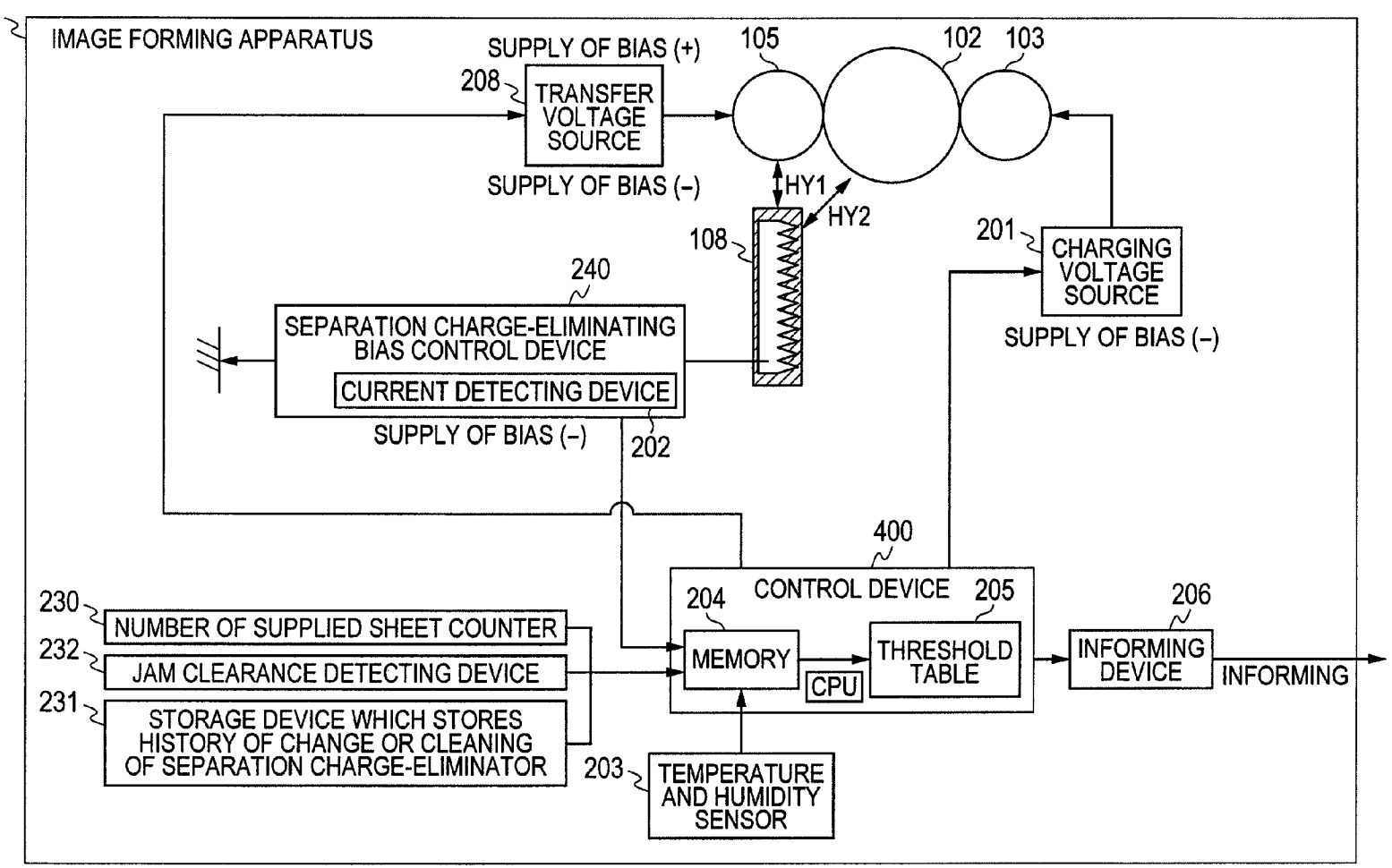
FIG. 12 is a block diagram illustrating a stain detecting structure for a separation charge-eliminator used in a third embodiment.

FIG. 12 is a block diagram of the stain detection according to this embodiment. In the structure of this embodiment, components having the same functions as those of the above-mentioned first embodiment are denoted by the same reference numerals, duplicate descriptions of which are omitted, and here, components different from those of the above-mentioned embodiment will be described. As illustrated in FIG. 12, the CPU included in the control device 400 controls the charging voltage applied to the charging roller 103 by the charging voltage source 201, and controls the charge-eliminating voltage applied to the separation charge-eliminator 108 by a separation charge-eliminating bias control device 240. Further, in this structure, the current flowing through the separation charge-eliminator 108 is detected by the current detecting device 202 formed of a current detecting circuit. The current detecting device 202 detects the current value of the current flowing through the separation charge-eliminator 108 when the charging voltage is applied, and also detects the current flowing through the separation charge-eliminator 108 when the charging voltage and the transfer voltage are applied. Then, the current value detected by the current detecting device 202 is stored in the memory 204 included in the control device 400.

Further provided are a number of supplied sheet counter 230 and a storage device 231, which stores a history of the changing or cleaning of the separation charge-eliminator 108. As a timing to detect the current value, when the image formation reaches a specified predetermined number of sheets after the separation charge-eliminator 108 is changed or cleaned, the first detected current value and the second detected current value are detected. In addition, a jam clearance detecting device 232 which detects that jam clearance is performed is provided, and as a timing to perform the stain detection, after the jam clearance that may cause the toner or the like to fly and pile up inside the machine, the first detected current value and the second detected current value are surely detected irrespective of the number of supplied sheets.

(Stain Detecting Procedure)

Hereinafter, a stain-detection control procedure according to this embodiment will be described with reference to the flowchart illustrated in FIG. 13. This processing is realized by having the CPU (FIG. 12) included in the control device 400 read and execute the control program stored in the memory 204.

First, the CPU causes the temperature and humidity sensor 203 to detect the environment inside the apparatus (S701), and refers to a table shown in FIG. 14 for the threshold value from the detected environment to change the processing (S702). After that, it is determined from the counted number of supplied sheets whether or not the number of supplied sheets has reached 30,000 after the previous maintenance (cleaning or changing of the separation charge-eliminator) (S703).

When the counted number of supplied sheets after the previous maintenance is less than 30,000, the CPU determines whether or not the jam clearance has been performed after jam detection (S712), and when there is no history of the jam clearance, nothing is processed.

On the other hand, when the counted number of supplied sheets after the previous maintenance has reached 30,000 or after the jam clearance has been performed, the CPU executes the stain detection for the separation charge-eliminator 108. Specifically, a negative voltage (in this embodiment, DC=−550 V and AC=1,300 V) is applied from the charging voltage source 201 to the charging roller 103 (S704). Further, the separation charge-eliminating bias is applied to the separation charge-eliminator 108 along with the application of the charging voltage (S705). Then, the first detected current value of the current flowing through the separation charge-eliminator 108 when the charge is applied is detected by the current detecting device 202 (S706).

At this time, because the voltage of −2,000 V is applied to the separation charge-eliminator 108, when the charging voltage of −550 V is applied in order to detect the first detected current value, the photosensitive drum 102 is −500 V, and the potential difference between the photosensitive drum 102 and the separation charge-eliminator 108 is 1,500 V, which is smaller than the potential difference between the transfer roller 105 and the separation charge-eliminator 108 (potential difference is 2,000 V because the transfer voltage is not applied to the transfer roller 105). In addition, the distance of 6 mm between the photosensitive drum 102 and the distal end of the separation charge-eliminator 108 is longer than the distance of 3 mm between the transfer roller 105 and the separation charge-eliminator 108.

However, the discharge between the separation charge-eliminator 108 and the photosensitive drum 102 or the transfer roller 105 is affected not only by the potential difference and the distance therebetween, but also by an orientation in which the charge-eliminating needle 108*a* of the separation charge-eliminator 108 is directed. In other words, the discharge is more likely to occur as the potential difference between the members becomes larger, as the distance becomes shorter, and as the orientation of the distal end portion of the charge-eliminating needle 108*a* is directed more closely to the target member. In addition, the charge-eliminating needle 108*a* is disposed in the orientation toward the photosensitive drum 102, and has the distal end disposed opposite to the photosensitive drum 102. In addition, the charge-eliminating needle 108*a* is not oriented toward the transfer roller 105. With this arrangement, even if the potential differences and the distances between the separation charge-eliminator 108 and the photosensitive drum 102 and between the separation charge-eliminator 108 and the transfer roller 105 are in the above-mentioned relationships, when the charging voltage is applied in order to detect the first detected current value, the discharge between the photosensitive drum 102 and the separation charge-eliminator 108 becomes more dominant than the discharge between the transfer roller 105 and the separation charge-eliminator 108. As a result, the discharge occurs from the photosensitive drum 102 to the distal end of the separation charge-eliminator 108, but no discharge occurs from the transfer roller 105 to the separation charge-eliminator 108. Hence, the first detected current value can be detected without causing the current to flow from the transfer roller 105 into the separation charge-eliminator 108.

Subsequently, the CPU refers to the threshold table determined in Step S702 to determine that the current caused to flow by the discharge from the photosensitive drum into the separation charge-eliminator is appropriate and there is no need to inform the user when the first detected current value is equal to or greater than the first threshold value. In other words, foreign matter (paper dust or toner) the amount of which is equal to or greater than a fixed amount does not adhere to the periphery of the distal end of the separation charge-eliminator 108, and hence it is determined that the current of which value is equal to or greater than the threshold value is flowing (S707).

In addition, the CPU determines whether or not the foreign matter adheres to the region (region along the surface of the charge-eliminating needle holder 301) between the transfer roller 105 and the charge-eliminating needle 108*a* of the charge-eliminating needle holder 301 holding the charge-eliminating needle 108*a*. For this reason, a positive voltage (in this embodiment, +500 V) from the transfer voltage source 208 is applied to the transfer roller 105 with the charging voltage being left turned ON (S708). Then, the second detected current value according to this embodiment which is flowing through the separation charge-eliminator 108 when the transfer voltage is applied is detected by the current detecting device 202 (S709).

Subsequently, the CPU refers to the threshold table determined in Step S702 to determine that the current caused to flow by the discharge from the transfer roller 105 into the separation charge-eliminator 108 is appropriate and there is no need to inform the user when the second detected current value according to this embodiment is equal to or greater than the second threshold value. In other words, the foreign matter the amount of which is equal to or greater than a fixed amount does not adhere between the transfer roller and the separation charge-eliminator, and hence it is determined that the current of which value is equal to or greater than the threshold value is flowing (S710).

In this manner, when the first detected current value is equal to or greater than the first threshold value and when the second detected current value is equal to or greater than the second threshold value, it can be determined that there is no adhesion of the foreign matter to both of the periphery of the distal end of the separation charge-eliminator 108 and the region between the charge-eliminating needle 108*a* and the transfer roller 105, and hence the information by the informing device is assumed to be unnecessary.

On the other hand, when the first detected current value is not greater than the first threshold value (S707), the CPU determines that the current caused to flow by the discharge between the separation charge-eliminator 108 and the photosensitive drum is not appropriate. In other words, it is determined that the foreign matter (paper dust or toner) the amount of which is equal to or greater than the fixed amount adheres to the periphery of the distal end of the separation charge-eliminator 108 with the result that the current value of the current flowing through the separation charge-eliminator 108 has become equal to or less than the threshold value.

Note that, the periphery of the distal end of the separation charge-eliminator 108 has a needle shape, and hence the cleaning for removing the foreign matter may impair the function of the separation charge-eliminator 108 due to a deformed needle. Therefore, in this embodiment, when the first detected current value is not greater than the first threshold value, the CPU determines that a timing to change the separation charge-eliminator 108 has arrived, and outputs a predetermined control signal to the informing device 206 to inform the user or the service person (user) that the separation charge-eliminator 108 needs to be changed (S713).

In addition, when the second detected current value is not greater than the second threshold value (S710), the CPU determines that the current caused to flow by the discharge between the separation charge-eliminator 108 and the transfer roller 105 is not appropriate. In other words, it is determined that the foreign matter the amount of which is equal to or greater than the fixed amount adheres between the transfer roller 105 and the separation charge-eliminator 108 with the result that the current value of the current flowing through the separation charge-eliminator 108 has become equal to or less than the threshold value.

Even if the region of the separation charge-eliminator 108 other than the distal end and the charge-eliminating needle holder 301, which are located between the transfer roller 105 and the separation charge-eliminator 108, are cleaned, the function is not impaired without deformation or the like. Therefore, when the second detected current value is not greater than the second threshold value, the CPU determines that a timing to clean the separation charge-eliminator 108 has arrived, and outputs a predetermined control signal to the informing device 206 to inform the user or the service person that the cleaning needs to be performed for the region between the transfer roller 105 and the separation charge-eliminator 108 (S711). Then, the charging voltage, the transfer voltage, and the separation charge-eliminating voltage are turned OFF, which brings the determination procedure to an end (S714).

As described above, the image forming apparatus according to this embodiment detects the respective current values of the current flowing through the separation charge-eliminator 108 when the charging voltage and the transfer voltage are applied in the respective environments. It is determined based on the current values whether the foreign matter adheres to the periphery of the distal end of the separation charge-eliminator 108, thereby necessitating the changing of the separation charge-eliminator 108, or the foreign matter adheres between the transfer roller 105 and the separation charge-eliminator 108, thereby necessitating only the cleaning of the region between the transfer roller 105 and the separation charge-eliminator 108.

In other words, the first detected current value which becomes smaller as the separation charge-eliminator 108 is further stained and the second detected current value are used to be compared respectively with the set threshold values, thereby enabling a determination as to whether or not the separation charge-eliminator 108 needs to be changed or only to be cleaned.

Further, the information that prompts the changing or cleaning of the separation charge-eliminator 108 can be given to the operation unit of the printer. Accordingly, compared to a case where the separation charge-eliminator 108 is changed regularly, the changing can be performed at an appropriate time, and unnecessary changing can also be reduced, which produces an effect of an improvement in maintenance efficiency.

Note that, the description is provided of the embodiment in which the informing device is provided in the printer, but even if the informing device is provided in the personal computer, the information can be displayed on a monitor or the like in the same manner.

Figure 13:
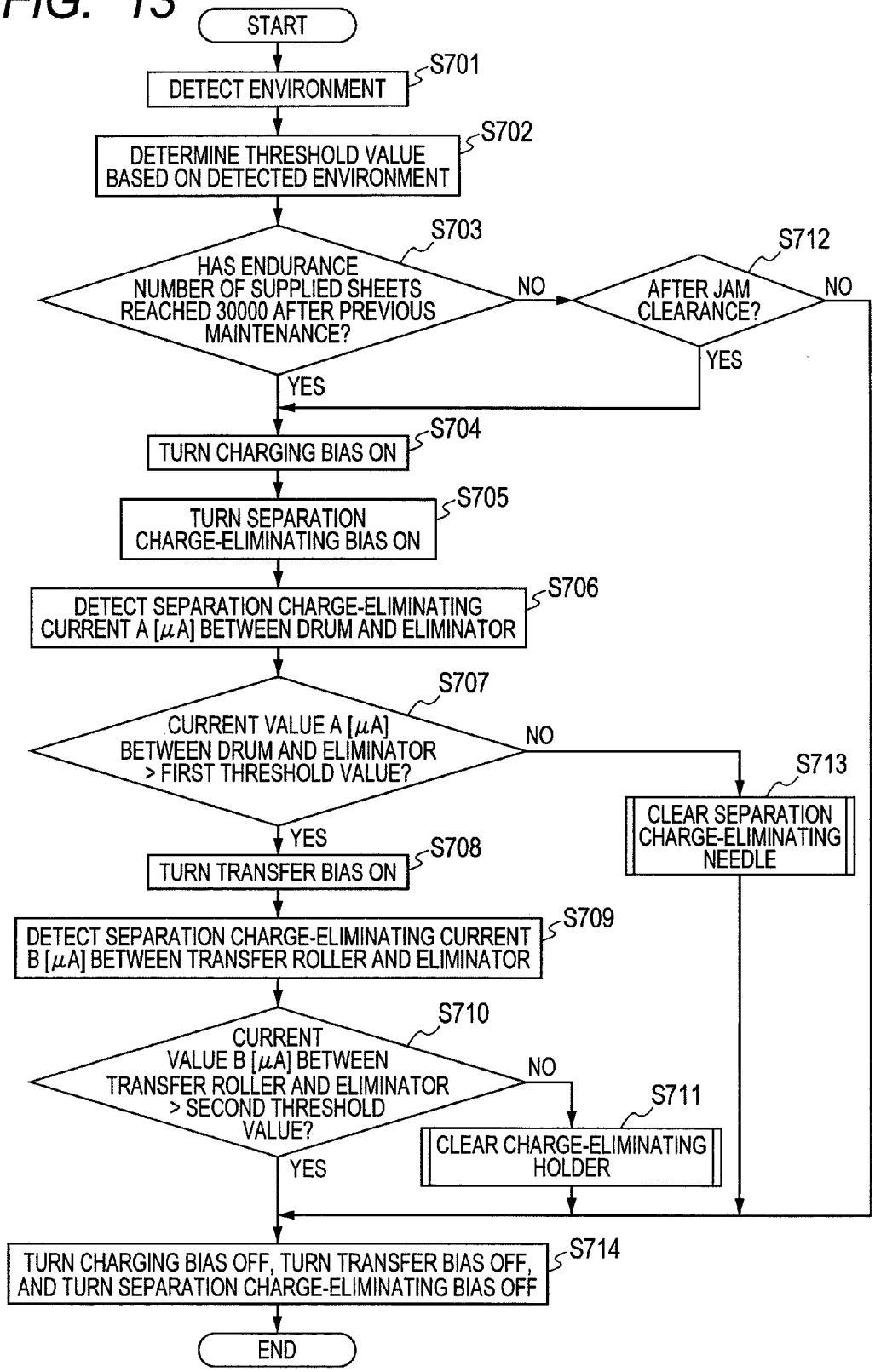
FIG. 13 is a flowchart illustrating a stain detecting procedure for the separation charge-eliminator according to the third embodiment.
Figure 15:
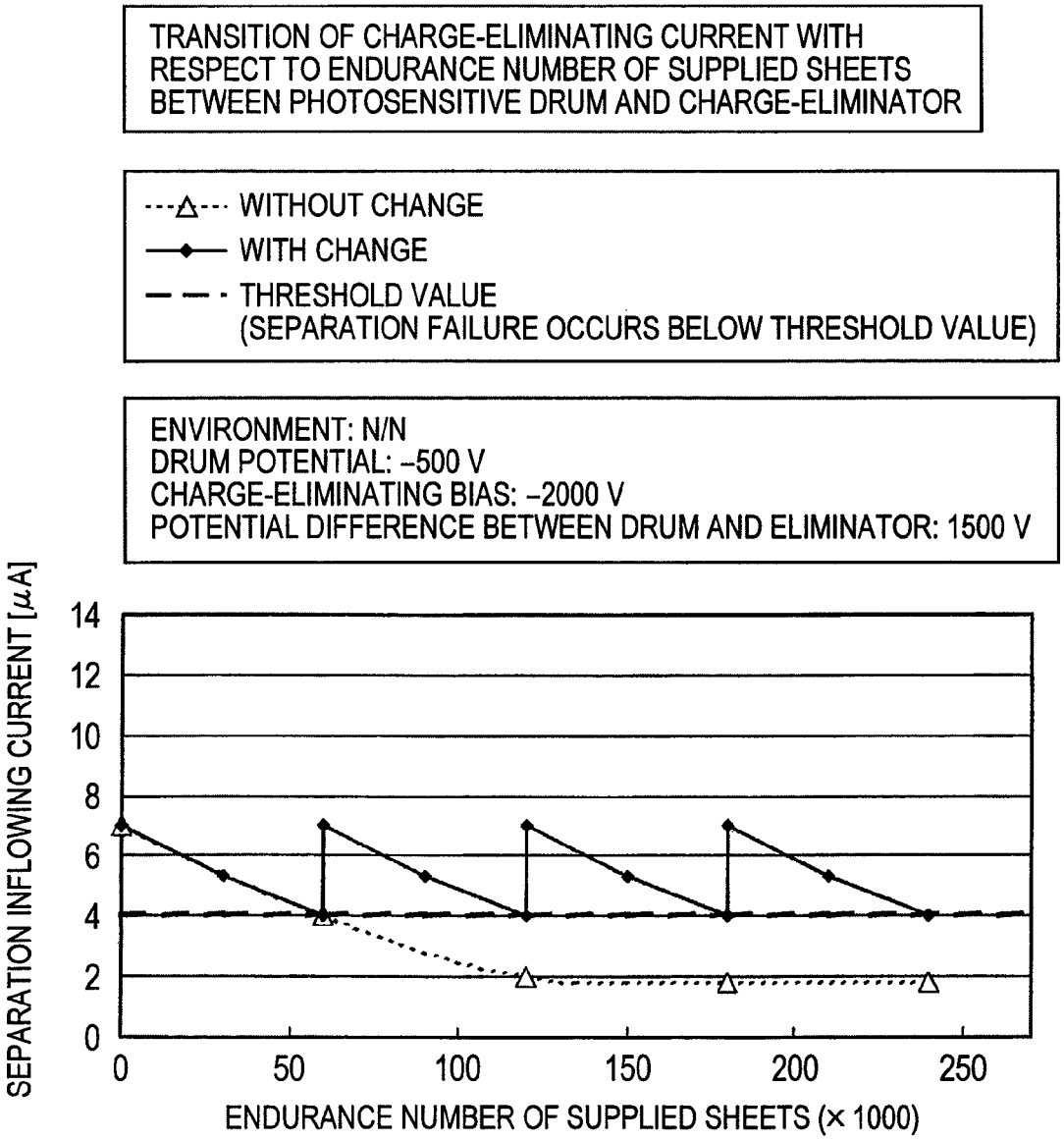
FIG. 15 is an endurance transition of an inflowing current between a photosensitive drum and the separation charge-eliminator according to the third embodiment.

FIG. 15 illustrates an endurance transition of a separation charge-eliminating current for the cases where the separation charge-eliminator is changed and is not changed, which is obtained from a determination result of Step S707 (means for determining whether or not the current caused to flow by the discharge between the separation charge-eliminator and the photosensitive drum is appropriate) in the flowchart of FIG. 13.

FIG. 15 is an example of a graph illustrating a relationship between the current values obtained when the charging voltage is applied in the cases where the separation charge-eliminator 108 is changed and is not changed.

The conditions illustrated in FIG. 15, which shows the transition of the detected amount (first detected current value) of the current caused to flow from the photosensitive drum 102 into the separation charge-eliminator 108 by applying the charging voltage, are that the photosensitive drum is charged to −500 V with the charging voltage of DC=−550 V and AC=1,300 V being applied in the NN environment (absolute amount of water vapor of 2 to 16 kg/kgD.A). In addition, the discharge is started by applying the separation charge-elimination voltage of −2,000 V to cause the potential difference between the photosensitive drum 102 and the separation charge-eliminator 108 (hereinafter, referred to as "between the photosensitive drum and the separation charge-eliminator") to be 1,500 V, which causes the current to flow from the separation charge-eliminator into the photosensitive drum. In FIG. 15, this inflowing current value is indicated by the vertical axis. The horizontal axis indicates an endurance number of supplied sheets.

Further, when the photosensitive drum potential is caused to approach the positive side in order to increase the flowing from the separation charge-eliminator into the photosensitive drum by making the potential difference between the photosensitive drum and the separation charge-eliminator, in a case where the recording medium is not supplied, the toner is developed on the photosensitive drum, which exerts an adverse effect that the toner flies inside the apparatus or to the transfer roller. For this reason, in FIG. 15, the same charging voltage of DC=−550 V and AC=1,300 V as conditions for a time of blank area image formation at a time of normal image formation is applied to effect a drum potential of Vd=−500 V being a photosensitive drum blank area potential. The separation charge-eliminating voltage is also set on the same conditions as those for the time of the normal image formation. Note that, in the case where the recording medium is not supplied, the photosensitive drum according to this embodiment has property for adjusting the potential of the surface of the photosensitive drum by being charged to the negative polarity and exposed, and hence damage such as the memory phenomenon is not done to the photosensitive drum even if the separation charge-eliminating voltage having the negative polarity is applied.

In this embodiment, as described above, the transfer voltage is not applied in order to avoid the inflowing current from occurring between the transfer roller and the separation charge-eliminator. However, the transfer voltage may be applied in a state in which the discharge based on the potential difference between the photosensitive drum 102 and the distal end of the charge-eliminating needle of the separation charge-eliminator 108 becomes more dominant than the discharge based on the potential difference between the transferring device and the separation charge-eliminator.

The threshold value of the inflowing current between the photosensitive drum and the separation charge-eliminator in the NN environment is +4 μA as shown in FIG. 14, and becoming equal to or less than +4 μA as illustrated in FIG. 15 may lead to the occurrence of the separation failure in which the recording medium cannot be separated from the photosensitive drum.

In the case where the stain detection according to this embodiment is not performed (in the case where the separation charge-eliminator is not changed), when the electric resistance of the separation charge-eliminator increases due to the stain to cause the endurance number of supplied sheets to reach equal to or greater than 60,000, the separation inflowing current becomes equal to or less than the threshold value of +4 μA that may lead to the occurrence of the separation failure. In that case, the information that prompts the changing of the separation charge-eliminator is given based on the determination result of Step S707 in the flowchart of FIG. 13. When the changing is performed, the separation inflowing current becomes an initial value of +7 μA. After that, while the endurance number of supplied sheets is counted up, when the separation inflowing current becomes equal to or less than the threshold value of +4 μA again, the information that prompts the changing is given.

On the other hand, the inflowing current between the photosensitive drum and the separation charge-eliminator, which is used for determining whether or not the threshold value that leads to the occurrence of the separation failure has been reached, has not reached equal to or less than the threshold value of +4 μA after 30,000 sheets, and hence there is no need to perform the changing. Therefore, the procedure proceeds to the determination of Step S710 (means for determining whether or not the current caused to flow by the discharge from the transfer roller into the separation charge-eliminator is appropriate) in the flowchart of FIG. 13.

Figure 16:
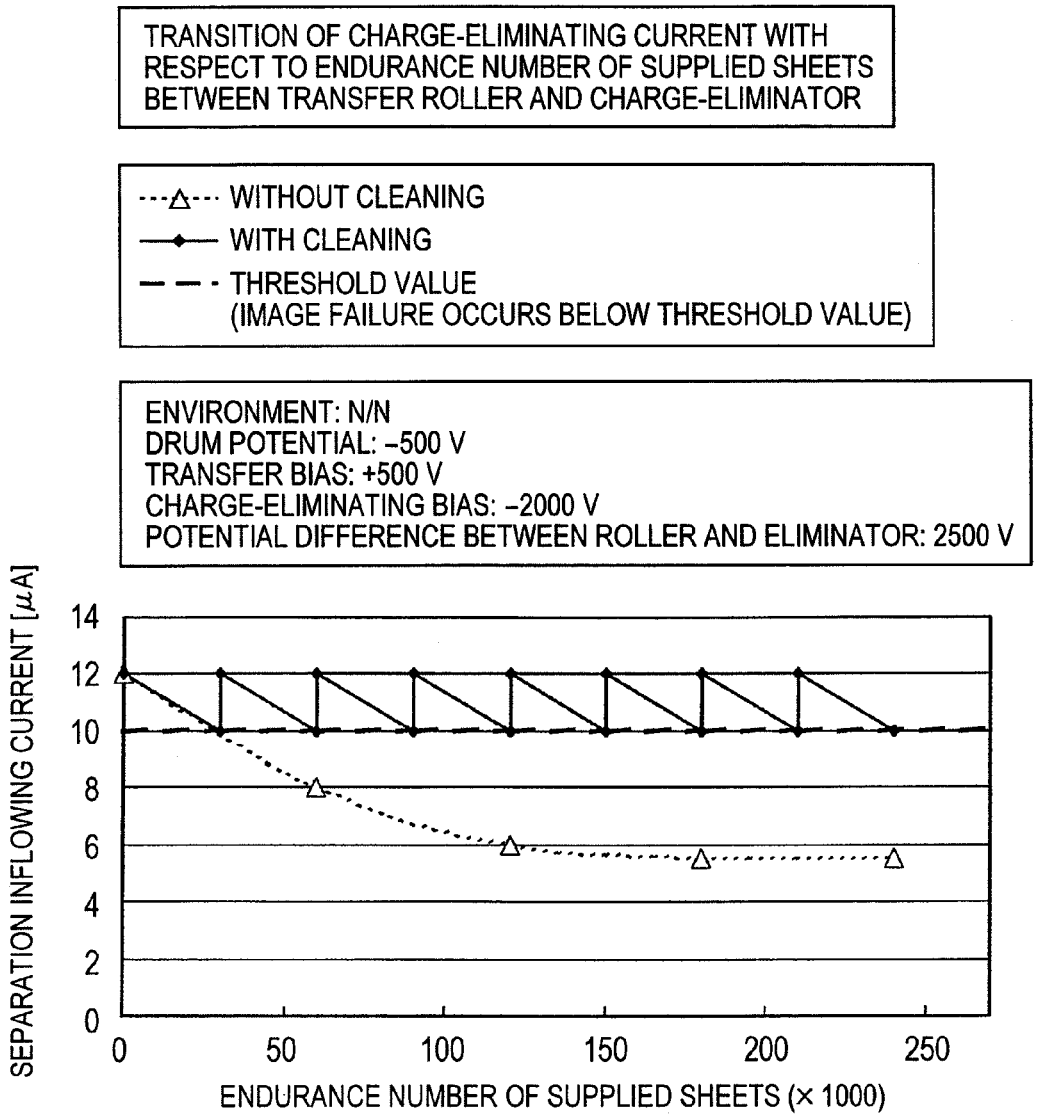
FIG. 16 is an endurance transition of the inflowing current between a transfer roller and the separation charge-eliminator according to the third embodiment.

FIG. 16 is an example of a graph illustrating the endurance transition of the separation charge-eliminating currents obtained in cases where the holder 301 located between the charge-eliminating needle 108*a* of the separation charge-eliminator 108 and the transfer roller 105 is cleaned or is not cleaned.

The conditions illustrated in FIG. 16, which shows the transition of the detected amount (second detected current value) of the current caused to flow from the transfer roller 105 into the separation charge-eliminator 108 by applying the transfer voltage, are that the photosensitive drum is charged to −500 V with the charging voltage of DC=−550 V and AC=1, 300 V being applied in the NN environment (absolute amount of water vapor of 2 to 16 kg/kgD.A). In addition, the discharge is started by applying the transfer voltage of +500 V and the separation charge-elimination voltage of −2,000 V to cause the potential difference between the transfer roller 105 and the separation charge-eliminator 108 (hereinafter, referred to as "between the transfer roller and the separation charge-eliminator") to be 2,500 V, which causes the current to flow from the transfer roller into the separation charge-eliminator. In FIG. 16, this inflowing current value is indicated by the vertical axis. The horizontal axis indicates an endurance number of supplied sheets.

Further, also in the case of FIG. 16, it suffices that the charging voltage to be applied is the negative polarity, but in order to prevent the toner from flying to the photosensitive drum, the same charging voltage of DC=−550 V and AC=1, 300 V as the conditions for the time of the blank area image formation being the conditions for the time of the normal image formation is applied to effect the drum potential of Vd=−500 V being the photosensitive drum blank area potential. The separation charge-eliminating voltage is also set on the same conditions as those for the time of the normal image formation.

Note that, in the case where the recording medium is not supplied, the photosensitive drum 102 according to this embodiment has the property for adjusting the potential of the surface of the photosensitive drum by being charged to the negative polarity and exposed, and hence damage, such as the arising of the memory phenomenon, is not done to the photosensitive drum 102 even if the separation charge-eliminating voltage having the negative polarity is applied.

As described above, also in this embodiment, in order to avoid damage from being done to the photosensitive drum 102, the charging voltage needs to be applied to charge the photosensitive drum 102 to the negative polarity.

However, when the transfer voltage is set to equal to or greater than +2,000 V (in order to increase the flowing from the photosensitive drum into the separation charge-eliminator by making the potential difference between the transfer roller and the separation charge-eliminator), the photosensitive drum is positively charged by the transfer voltage, which causes the memory phenomenon in which the photosensitive drum cannot be negatively charged satisfactorily by the charging voltage, and hence the transfer voltage of +500 V is applied.

Further, even if the transfer voltage of +500 V is applied, if the photosensitive drum 102 is left positively charged due to the application of the transfer voltage without applying the charging voltage, there is a fear of causing the memory phenomenon in which the photosensitive drum cannot be negatively charged satisfactorily by the charging voltage when the image is formed. For this reason, in this embodiment, in order to prevent the occurrence of the memory phenomenon, as described above, the transfer voltage is applied while not only the transfer voltage, but also the charging voltage is applied.

Note that, the first current value and the second current value can be detected without applying the above-mentioned the separation charge-eliminating voltage, but the current value can be detected with high accuracy by applying the separation charge-eliminating voltage as described above.

The threshold value of the inflowing current between the transfer roller and the separation charge-eliminator in the NN environment is +10 μA as shown in FIG. 14, and becoming equal to or less than +10 μA as illustrated in FIG. 16 may reduce the amount of a transferring positive charge flowing through the separation charge-eliminator and may lead to the occurrence of an image failure.

In the case where the stain detection according to this embodiment is not performed (in the case where the separation charge-eliminator is not cleaned), when the electric resistance of the separation charge-eliminator 108 increases due to the stain between the transfer roller and the separation charge-eliminator holder to cause the endurance number of supplied sheets to reach equal to or greater than 30,000, the separation inflowing current becomes equal to or less than the threshold value of +10 μA that may lead to the occurrence of the image failure. In that case, the information that prompts the cleaning of the separation charge-eliminator 108 between the transfer roller and the separation charge-eliminator holder is given based on the determination result of Step S710 within the flowchart of FIG. 13. When the cleaning is performed, the separation inflowing current becomes an initial value of +12 μA. After that, while the endurance number of supplied sheets is counted up, when the separation inflowing current becomes equal to or less than the threshold value of +10 μA again, the information that prompts the cleaning is given.

In this manner, by determining in Step S707 whether or not the inflowing current between the photosensitive drum and the separation charge-eliminator is equal to or less than the threshold value, the need for the changing is informed of because the cleaning may cause breakage of the separation charge-eliminator.

Further, by determining in Step S710 whether or not the inflowing current between the transfer roller and the separation charge-eliminator is equal to or less than the threshold value, the need for only the cleaning of the region between the transfer roller and the separation charge-eliminator holder, which may not cause breakage, is informed of.

This prevents the unnecessary changing of the separation charge-eliminator and the breakage of the separation charge-eliminator, and the maintenance suitable for the stained state of the separation charge-eliminator can be informed of.

Note that, this embodiment is described by taking the example in which, when the first detected current value and the second detected current value are detected, the charging voltage and the transfer voltage to be applied are set to have the values of the charging voltage and the transfer voltage applied in the image formation in the same manner as in the first embodiment. However, the value of the voltage dedicated to the stain detection of the separation charge-eliminator may be set as well. In other words, the respective voltages may be applied (including the case of OFF-state) so that the discharge between the photosensitive drum 102 and the separation charge-eliminator 108 becomes more dominant than the discharge between the transfer roller 105 and the separation charge-eliminator 108 when the first detected current value is detected and so that the discharge between the transfer roller 105 and the separation charge-eliminator 108 becomes more dominant than the discharge between the photosensitive drum 102 and the separation charge-eliminator 108 when the second detected current value is detected.

For example, when the first detected current value is detected, compared with the time of the image formation, the charging voltage is increased by −200 V to apply the charging voltage of DC=−750 V and AC=1,300 V, while in the case where the photosensitive drum is charged to −700 V, the separation charge-eliminating voltage of −2,200 V is applied without applying the transfer voltage to the transfer roller 105. With this operation, the potential difference between the photosensitive drum 102 and the separation charge-eliminator 108 becomes 1,500 V to thereby start the discharge, and the current is caused to flow from the photosensitive drum into the separation charge-eliminator, which may enable the first detection.

Further, the charging voltage is decreased by −200 V to apply the charging voltage of DC=−350 V, AC=1,300 V, while in the case where the photosensitive drum is charged to −300 V, the separation charge-eliminating voltage of −1,800 V is applied without applying the transfer voltage to the transfer roller 105. With this operation, the potential difference between the photosensitive drum 102 and the separation charge-eliminator 108 becomes 1,500 V to thereby start the discharge, and the current is caused to flow from the photosensitive drum into the separation charge-eliminator, which may enable the first detection.

Similarly in the case where the second detected current value is detected, limitation to the above-mentioned value is not necessarily imposed, and the charging voltage, the transfer voltage, the separation charge-eliminating voltage that are used which detects the discharge states therebetween with accuracy may be respectively applied (including the case of OFF-state).

According to the above-mentioned embodiment, by using the current value of the current flowing through the separation charge-eliminator to detect the state in which the paper dust, the toner, or the like adheres to the distal end or the periphery of the separation charge-eliminator, it is possible to determine the timing for the maintenance such as the cleaning or the changing of the separation charge-eliminator with accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-275695, filed Dec. 10, 2010, and Japanese Patent Application No. 2011-269859, filed Dec. 9, 2011, which are hereby incorporated by reference herein in their entirety.

What is claimed is:

1. An image forming apparatus, comprising:

an image bearing member;

a charging device configured to apply a charging voltage to the image bearing member;

a developing device configured to develop an electrostatic image formed on the image bearing member by using toner;

a transferring device configured to apply a transfer voltage to a recording medium to transfer a toner image formed on the image bearing member onto the recording medium;

a separation charge-eliminator configured to separate the recording medium, on which the toner image has been transferred by the transferring device, from the image bearing member;

a current detecting device configured to detect a current flowing through the separation charge-eliminator; and a determining device configured to determine a deterioration in a charge-elimination function of the separation charge-eliminator based on a current value detected by the current detecting device with the image bearing member being charged by the charging device.

2. An image forming apparatus according to claim 1, wherein, in a case where the current value is detected by the current detecting device, the charging voltage and the transfer voltage are set so that a discharge amount between the image bearing member and the separation charge-eliminator becomes larger than a discharge amount between the transferring device and the separation charge-eliminator.

3. An image forming apparatus according to claim 1, wherein, in a case where the determining device causes the current detecting device to detect the current value, the current value is detected with the image bearing member being charged by the charging device while the transfer voltage is applied so that a discharge amount generated between the image bearing member to which the charging voltage is applied by the charging device and the separation charge-eliminator disposed so as to have a distal end opposite to the image bearing member becomes larger than a discharge amount generated between the transferring device which applies the transfer voltage to the recording medium and the separation charge-eliminator disposed so as to be adjacent to the transferring device.

4. An image forming apparatus according to claim 1, wherein, in a case where the determining device causes the current detecting device to detect the current value, the current value is detected with the image bearing member being charged by the charging device without applying the transfer voltage to the recording medium.

5. An image forming apparatus according to claim 1, wherein the determining device is configured to determine the deterioration in charge-elimination function of the separation charge-eliminator due to an influence of a foreign matter adhering to a support member configured to support the separation charge-eliminator based on a current value detected by the current detecting device with the image bearing member being charged by the charging device in a state in which a transfer voltage is applied to the transferring device.

6. An image forming apparatus according to claim 5, wherein, in a case where the current value is detected by the current detecting device, the charging voltage and the transfer voltage are set so that a discharge amount between the transferring device and the separation charge-eliminator becomes larger than a discharge amount between the image bearing member and the separation charge-eliminator.

7. An image forming apparatus according to claim 5, wherein, in a case where the determining device causes the current detecting device to detect the other current value, the other current value is detected with the transfer voltage being applied to the transferring device while the charging voltage is applied so that a discharge amount generated between the transferring device and the separation charge-eliminator when the transfer voltage is applied to the transferring device becomes larger than a discharge amount generated between the image bearing member and the separation charge-eliminator when the charging voltage is applied to the image bearing member.

8. An image forming apparatus according to claim 5, wherein, in a case where the determining device causes the current detecting device to detect the other current value, the other current value is detected with the transfer voltage being applied to the transferring device while the same charging voltage as that used in image formation is applied to the image bearing member.

9. An image forming apparatus according to claim 5, wherein, in a case where the determining device causes the current detecting device to detect the other current value, the other current value is detected with the transfer voltage being applied to the transferring device without applying the charging voltage to the image bearing member.

10. An image forming apparatus according to claim 5, wherein the determining device determines whether or not changing of the separation charge-eliminator is needed based on the current value, and when the determining device determines that the changing is not needed, the determining device also determines whether or not cleaning of the separation charge-eliminator is needed based on the other current value.

11. An image forming apparatus according to claim 10, further comprising an environment detecting device which detects a relative humidity and a temperature in an image forming apparatus main body, wherein the determining device stores a threshold table in which respective threshold values corresponding to the current value and the other current value are set according to the relative humidity and the temperature detected by the environment detecting device.

12. An image forming apparatus according to claim 10, further comprising a display device which displays information that the separation charge-eliminator needs to be changed or cleaned based on a determination result from the determining device.

13. An image forming apparatus according to claim 10, further comprising a cleaning device which cleans the separation charge-eliminator, wherein the cleaning device cleans the separation charge-eliminator based on the other current value.

14. An image forming apparatus according to claim 5, wherein the detection timing at which the determining device detects for the current value and the other current value is after image formation of a predetermined number of sheets is performed or after jam clearance is performed.

15. An image forming apparatus according to claim 1, further comprising an informing device which informs a user about the separation charge-eliminator based on a control signal output by the determining device.

16. An image forming apparatus according to claim 1, further comprising a cleaning device which cleans the separation charge-eliminator, wherein the cleaning device cleans the separation charge-eliminator based on a control signal output by the determining device.

17. An image forming apparatus according to claim 1, wherein the determining device determines a state of a foreign matter adhering to a support member configured to support the separation charge-eliminator by comparing the current value detected by the current detecting device with the image bearing member being charged by the charging device in a state in which the transfer voltage is not applied to the transferring device with a current value detected by the current detecting device with the transfer voltage being applied to the transferring device in a state in which the image bearing member is not charged by the charging device.

18. An image forming apparatus comprising:

an image bearing member;

a charging device configured to apply a charging voltage to the image bearing member;

a developing device configured to develop an electrostatic image formed on the image bearing member by using toner;

a transferring device configured to apply a transfer voltage to a recording medium to transfer a toner image formed on the image bearing member onto the recording medium;

a separation charge-eliminator configured to separate the recording medium, on which the toner image has been transferred by the transferring device, from the image bearing member;

a current detecting device configured to detect a current flowing through the separation charge-eliminator; and a display device configured to display information on a charge-elimination function of the separation charge-eliminator based on a current value detected by the current detecting device with a transfer voltage being applied to the transferring device.

19. An image forming apparatus, comprising:

an image bearing member;

a charging device configured to apply a charging voltage to the image bearing member;

a developing device configured to develop an electrostatic image formed on the image bearing member by using toner;

a transferring device configured to apply a transfer voltage to a recording medium to transfer a toner image formed on the image bearing member onto the recording medium;

a separation charge-eliminator configured to separate the recording medium, on which the toner image has been transferred by the transferring device, from the image bearing member;

a current detecting device configured to detect a current flowing through the separation charge-eliminator; and a determining device configured to determine a state of change in resistance of the separation charge-eliminator based on a current value detected by the current detecting device with the image bearing member being charged by the charging device in a case where the charging voltage and the transfer voltage are set so that a discharge amount between the image bearing member and the separation charge-eliminator becomes larger than a discharge amount between the transferring device and the separation charge-eliminator.

20. An image forming apparatus, comprising:

an image bearing member;

a charging device configured to apply a charging voltage to the image bearing member;

a developing device configured to develop an electrostatic image formed on the image bearing member by using toner;

a transferring device configured to apply a transfer voltage to a recording medium to transfer a toner image formed on the image bearing member onto the recording medium;

a separation charge-eliminator configured to separate the recording medium, on which the toner image has been transferred by the transferring device, from the image bearing member;

a current detecting device configured to detect a current flowing through the separation charge-eliminator; and a determining device configured to determine a state of change in resistance of the separation charge-eliminator based on a current value detected by the current detecting device with the image bearing member being charged by the charging device in a state in which the charging voltage is applied to the charging device without applying the transfer voltage to the transferring device.

21. An image forming apparatus, comprising:

an image bearing member;

a charging device configured to apply a charging voltage to the image bearing member;

a developing device configured to develop an electrostatic image formed on the image bearing member by using toner;

a transferring device configured to apply a transfer voltage to a recording medium to transfer a toner image formed on the image bearing member onto the recording medium;

a separation charge-eliminator configured to separate the recording medium, on which the toner image has been transferred by the transferring device, from the image bearing member;

a current detecting device configured to detect a current flowing through the separation charge-eliminator; and a determining device configured to determine a state of change in resistance of the separation charge-eliminator based on a current value detected by the current detecting device with the image bearing member being charged by the charging device at a time when the recording medium is not supplied.

* * * * *